US007708483B2

(12) United States Patent
Samii et al.

(10) Patent No.: US 7,708,483 B2
(45) Date of Patent: May 4, 2010

(54) UNBACKED FABRIC TRANSPORT AND CONDITION SYSTEM

(75) Inventors: Mohammad M Samii, La Jolla, CA (US); Mark A. Van Veen, Cardiff by the Sea, CA (US); Jack H Schmidt, Oceanside, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1230 days.

(21) Appl. No.: 11/256,382

(22) Filed: Oct. 21, 2005

(65) Prior Publication Data

US 2006/0033796 A1 Feb. 16, 2006

Related U.S. Application Data

(62) Division of application No. 10/388,060, filed on Mar. 12, 2003, now Pat. No. 6,988,797.

(51) Int. Cl.
*B41J 15/04* (2006.01)
*B41J 2/01* (2006.01)

(52) U.S. Cl. ..... 400/618; 400/635; 400/613; 400/619; 400/614; 347/104

(58) Field of Classification Search ..... 400/635
See application file for complete search history.

(56) References Cited

U.S. PATENT DOCUMENTS 4,323,905 A 4/1982 Reitberger et al. ..... 347/6
5,825,501 A * 10/1998 Mee et al. ..... 356/429
5,877,797 A 3/1999 Miyashita et al.
5,936,665 A * 8/1999 Vachtsevanos et al. ..... 348/91
6,149,257 A 11/2000 Yanaka et al.
6,183,074 B1 2/2001 Miyashita et al.
6,195,475 B1 * 2/2001 Beausoleil et al. ..... 382/312
6,361,230 B1 3/2002 Crystal et al.
6,375,293 B1 4/2002 Endo
6,601,951 B2 8/2003 Kuwabara et al. ..... 347/101
6,702,438 B2 * 3/2004 Codos et al. ..... 347/106
7,601,978 B2 * 10/2009 Sari-Sarraf et al. ..... 250/559.08
2002/0005870 A1 1/2002 Codos et al.
2002/0060728 A1 5/2002 Koizumi et al.
2003/0030686 A1 * 2/2003 Abe et al. ..... 347/16
2003/0160851 A1 * 8/2003 Baccay et al. ..... 347/101
2004/0244621 A1 * 12/2004 Samii ..... 101/483

FOREIGN PATENT DOCUMENTS

EP 0 953 454 11/1999
JP 58215385 A 12/1983
JP 04141425 A 5/1992

(Continued)

*Primary Examiner*—Daniel J Colilla

(57) ABSTRACT

An unbacked transport and conditioning printing system for printing a pattern on a fabric is disclosed. The system includes a fabric characterization and tension control subsystem for gathering information on variations in the fabric and an irregularity detection subsystem for detecting irregularities in the fabric, as well as, crease detection and removal. The fabric passes through a fabric drying and conditioning subsystem for characterization of the fabric. The system also includes a fabric control subsystem for advancing the fabric through a print zone, where a pattern is printed on an unbacked fabric. The fabric is transported through a drying and post-processing subsystem and a closed-loop color control subsystem.

24 Claims, 19 Drawing Sheets

FOREIGN PATENT DOCUMENTS

| | | | | |
|---|---|---|---|---|
| JP | 08311782 | | | 11/1996 |
| JP | 08311782 | A | * | 11/1996 |
| JP | 2002138361 | A | * | 5/2002 |
| JP | 2002294547 | | | 10/2002 |
| WO | WO 99/47354 | | | 9/1999 |
| WO | WO 9947354 | A1 | * | 9/1999 |

* cited by examiner

UNBACKED FABRIC TRANSPORT AND CONDITION SYSTEM

This is a division of application Ser. No. 10/388,060, filed Mar. 12, 2003 now U.S. Pat. No. 6,988,797.

FIELD OF THE INVENTION

The present invention generally relates to textile printing systems.

BACKGROUND OF THE INVENTION

In the fabric printing industry, fabrics are typically colored with coloring agents, such as dyes or pigments, using a screen printing technology. Most large-scale fabric printing operations employ rotary screen printing technologies that utilize patterns incorporated into fine metal screens that are shaped into cylindrical forms. The coloring agents, are often in a fluid paste form, are pumped through dedicated tubing into the interior of fine cylindrical metal screens and are subsequently transferred to the fabric through the patterned pathways in the fine metal screens by a squeegee that presses the paste through the screens and onto the fabric. After each screen print run, with each color way (i.e., a color variant of the same pattern that uses different color combination), the rotary screen printer must be shut down to clean the various color pastes from the tubing and screens. This cleanup process is time intensive and environmentally unfriendly because it produces a large amount of effluent stream during the cleanup process. In addition to cleaning the rotary screen printer, a different screen must be inserted, aligned and adjusted into the printer to print a different pattern on the fabric.

To ensure that the pattern printed on the fabric is not distorted, industrial fabric printing machines stretch the fabric, and subsequently glue the stretched fabric to a belt that is run through the printing machine. The moving belt is indexed through the printing machine and the various screen stages. By attaching the fabric to the belt, the fabric is prohibited from moving with respect to the belt, which ensures fabric motion control that helps guarantee adequate registration of the fabric through the various stages in such a way that the fabric moves in a path corresponding to the movement path of the belt. However, gluing the fabric to the belt is an extremely dirty process that creates a significant environmentally unfriendly waste stream resulting from the gluing process and the subsequent washing and stripping processes. These inherent problems make industrial fabric printing processes prohibitive for use by smaller-scale users in the short run or sample printing situations. Furthermore the need for short and sample quantity runs generally exists in an office or a store setting, which generally is not designed to handle, treat and dispose of industrial waste streams.

To remedy the need for printing processes available on a smaller than industrial scale, digital ink-jet printing processes on fabrics have been developed. As known to those of ordinary skill in the art, digital printers utilize minute droplets of ink colorant that are ejected from nozzles of the ink-jet printer onto a target surface, such as, paper or fabric. In order to produce an image or pattern with the desired print quality on the fabric, special pre and post-treatment processes are employed. Pre & Post printing processes are used to deposit an ink receptive layer, and then to condition the fabric and the ink receptive layer for optimal print quality condition. Finally, the colorants require a fixing process (post processing) that either physically or chemically fix the colorants to the fabric fibers. The pre-printing conditioning steps are used to initially control the humidity and temperature of the fabric to provide an optional ink reception state for the fabric, and the post-processing steps are used to "fix" the ink colorant to the fabric, after the ink colorant has been received by the fibers in the fabric. In addition, pre-treating the fabric with organic materials increases ink receptivity and reduces the amount of ink spread, which arises from bleeding of the printed ink along the fibers in the fabric. The ink colorant is generally prevented from "blowing through" in digital printing systems by laminating the fabric with a paper-backing layer. This produces a barrier to the ink "blow through." The paper layer also stabilizes the fabric for feeding through a traditional ink-jet printer media path.

Backed fabrics may be passed through some modified ink-jet printers for the printing of a pattern on the backed fabric. However, the use of off-line paper backings may be costly, time consuming, and may limit the range of fabrics that may be fed through the ink-jet printer. Furthermore, the fabric may be damaged when the fabric is removed from the paper backing. Thus, printing on unbacked fabrics is often desirable.

As known to those of ordinary skill in the art, the problems of printing on unbacked fabrics using an ink-jet printer are not trivial. The fundamental nature of woven fabrics makes feeding the unbacked fabric and printing a pattern on the unbacked fabric more complex than traditional ink-jet printing on paper. For instance, fabrics have an almost infinite variation in fabric characteristics due to various factors including, but not limited to, the type of fiber used in the fabric, the fiber weight, the fabric weight, the different blends of materials used in the fiber, the weave pattern used to create the fabric, the environmental conditions existing at the time of printing, the pre-treatments used on the fabric, the surface finish of the fabric, the varying moisture contents of the fiber in the fabric, the non-linear behavior of woven materials, and the difference in fabric behavior between wet and dry fabrics. These factors prohibit the unbacked fabrics from moving accurately and uniformly through the printing processes using standard media-moving machines used in the traditional ink-jet printers.

The challenge is to make a clean, versatile and user-friendly, unbacked printing system for non-mill applications for producing printed fabrics in the short run and sampling quantities. An inkjet textile printing system that addresses the issues of tension control, closed-loop displacement control, fabric conditioning, and fabric motion control using an unbacked fabric transfer system would be desirable. A digital ink-jet textile printing system that produces printed patterns consistently, with a low level of distortion, and yet is practical for use in the short-run and sampling industries, would likewise be desirable. Of course, improvements to a printing system that allow the ink-jet printer to print a pattern with a low level of distortion on the unbacked fabric would also have utility in industrial screen printing processes, especially for proofing, color matching, and precise pattern replication needs.

BRIEF SUMMARY OF THE INVENTION

In accordance with one embodiment of the invention, an unbacked fabric transport and conditioning system for printing a pattern on a fabric is disclosed. A winding subsystem is included in the unbacked fabric transport and conditioning system that rotates a roll of the fabric. The unbacked fabric transport and conditioning system also includes a fabric characterization and tension control subsystem, for obtaining real time information on variations in the mechanical behavior of the fabric, throughout the whole length or the fabric roll. The unbacked fabric transport and conditioning system may further include an ink-jet printer configured for depositing ink in a pattern on the fabric.

A method for printing a pattern on a fabric is also disclosed. In a particular embodiment of the invention, the method includes unwinding a fabric from a fabric roll, and draping the fabric between rollers. The apex of the draped fabric can be then be sensed by a level sensor. The unwinding speed of the fabric is controlled by observing the apex of the draped fabric, with a set of sensors. Subsequently, the characteristics of the fabric are ascertained by observing the weave pattern variations as a function of the predetermined strain condition in the fabric. A pattern is then printed on the fabric, the printed image is dried and post processed. The printed fabric is then rewound on a roll.

A digital printing system that transports, conditions, and prints a pattern on an unbacked fabric is also described. In another embodiment of the invention, the printing system includes an unwind system for unrolling the fabric from a roll. The unwind system comprises a first advance motor configured to unroll the fabric from the roll and a first fabric level sensor for detecting an amount of the fabric draped from the roll of fabric. A fabric characterization subsystem gathers information on variations in the fabric, and is included in the printing system. The fabric characterization subsystem contains a pair of skewed & driven rollers for the specific purpose of inducing a variety of strain patterns in the fabric, and cameras for observing the mechanical response of the fabric. The printing system further includes an irregularity detection subsystem for discovering irregularities in the fabric. The irregularity detection subsystem comprises of a pair of rollers for stretching the fabric, and the aforementioned camera for observing the irregularities in the fabric. A fabric control subsystem including a plurality of motion synchronized belts for advancing the fabric through a print zone that is also included within the printing system. A printing subsystem configured to deposit ink on the fabric may also be included in the printing system. The printing system may also include a closed-loop color control subsystem for detecting color variations in the ink deposited on the fabric.

BRIEF DESCRIPTION OF THE SEVERAL VIEWS OF THE DRAWINGS

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

The invention described herein is directed to an unbacked fabric transport and conditioning system for use with fabric printing processes that use digital ink-jet printers or other printing devices that deposit ink colorants on a fabric. More specifically, a system that characterizes the unbacked fabric before the fabric is presented to the print zone is disclosed. The present system enables a user to print a pattern on an unbacked fabric, or other textiles, with an ink-jet printer, and actively controls the distortion of the printed image on the fabric. As used herein, the term "pattern" will be used to refer to any type of design, mark, figure, identification code, graphic, work, image, or the like which may be printed. It will be apparent from the following description that the drawings described herein used to represent various features of the present invention are not drawn to scale, but are rather for illustrative and exemplary purposes only.

Referring now to drawing FIG. 1, there is shown a schematic diagram of an un-backed fabric transport and conditioning system (hereinafter "UFTCS") employing teachings of the present invention generally at 10. The UFTCS 10 broadly includes three zones. For ease of explanation, dashed lines 12 have been added to the diagram to separate the UFTCS 10 into the three zones. The first zone is a material delivery, characterization, and conditioning zone indicated generally at 100. The second zone is a print and printer control zone indicated generally at 200, and the third zone is a post print processing, drying, and rewind zone indicated generally at 300.

Each of the three zones 100, 200 and 300 includes various subsystems, wherein each subsystem performs a function that will be described in the following detailed description. It will be apparent that the various subsystems and components of each zone 100, 200 and 300 of the UFTCS 10 described herein may have utility in other broader fields of textile printing and weaving systems, other than digital printing systems employing an ink-jet printer, such as industrial screen printing systems.

Figure 1:
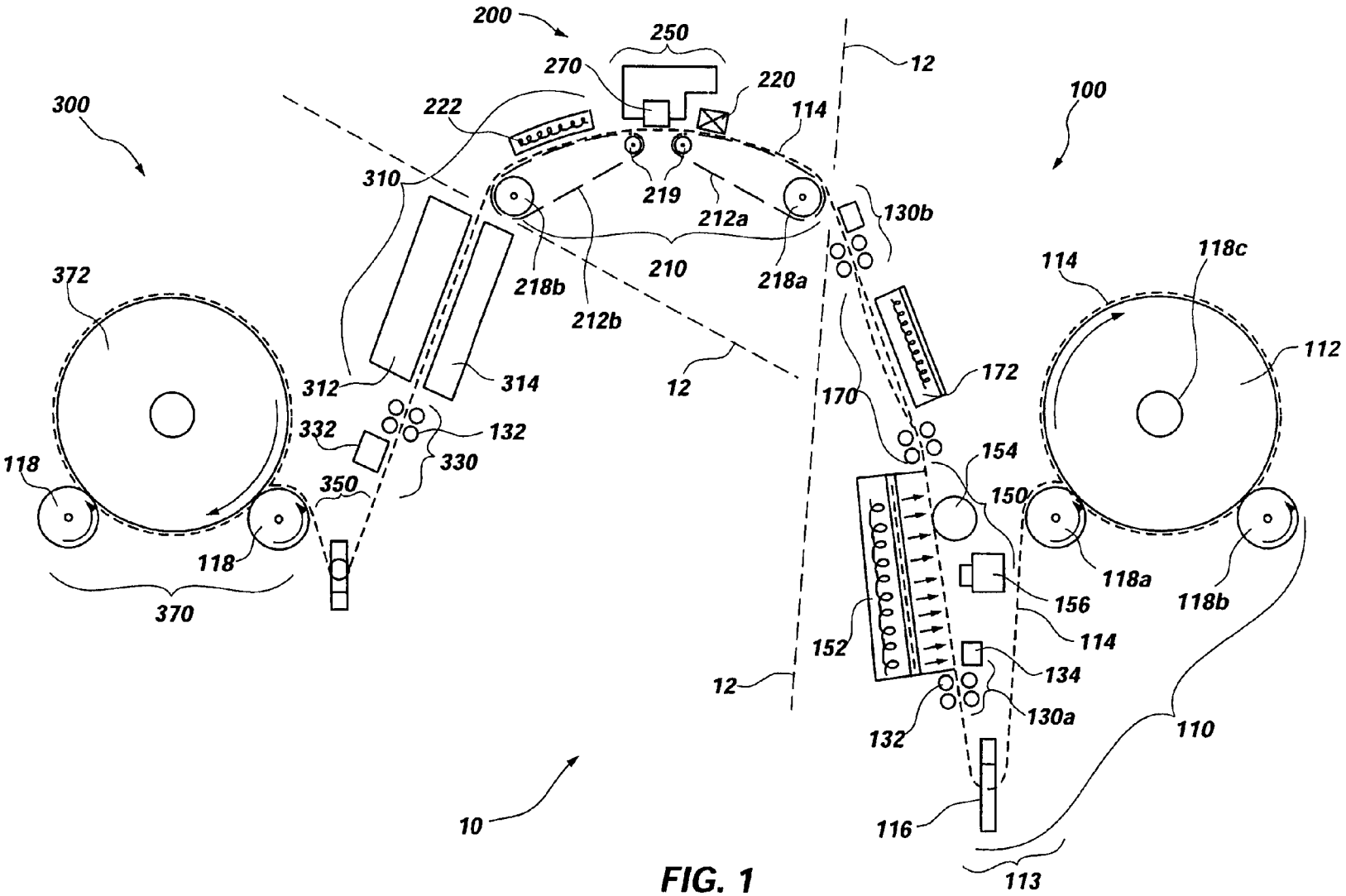
FIG. 1 is a schematic diagram of an unbacked fabric transport and conditioning system according to one embodiment of the present invention.

As shown in FIG. 1, the material delivery, characterization, and conditioning zone 100 includes components within an unwind subsystem indicated by bracket 110, components within two fabric characterization and tension control subsystems illustrated with brackets 130*a* and 130*b*, components within a crease, and irregularity detection and crease removal subsystem 150, and components within a fabric drying and conditioning subsystem 170. Although various components described herein will be referred to as being within a subsystem or zone, the subsystems and zones described herein are not meant to be so limited. It will be apparent that various components may be added or removed from particular subsystems or zones and not depart from the scope of the present invention. Also, some components described herein may be located in and have use in more than one subsystem. Further, some of the subsystems described herein may be located in more than one zone. The UFTCS 10 may be controlled by a single central processing unit (CPU), such as a computer (not illustrated), which receives, processes, and advances information received from various sensors and subsystems described herein. In an alternative embodiment, each sensor or subsystem may also have a separate, dedicated CPU that controls and processes data received from the individual sensor or subsystem and transfers the data to the CPU for further processing and the derivation of control signals for the subsystems of the UFTCS 10.

The unwind subsystem 110 is used to unwind a fabric roll 112, and relax and dissipate winding stresses that were induced in a fabric 114 when the fabric 114 is rolled and stored on the fabric roll 112. The unwind subsystem 110 includes an optical fabric level sensor 116 operably connected to a standard surface- or center-wound unwind station that receives control feed signals from the optical fabric level sensor 116. Advance signals from the optical fabric level sensor 116 are issued to rollers 118*a* and 118*b* in the case of a surface wound system, or the roller 118*c* in a center wound system in a synchronous manner to speed up, slow down, or stop the unwinding of the fabric roll 112. As illustrated, the fabric 114 drapes from roller 118*a* towards the optical fabric level sensor 116. The fabric 114 is subsequently taken up by skewed rollers 132. A relaxation zone 113 is also present in the unwind subsystem 110, wherein stresses introduced into the fabric 114 during winding, and storage of the fabric 114 in the roll 112 are relieved.

Figure 2:
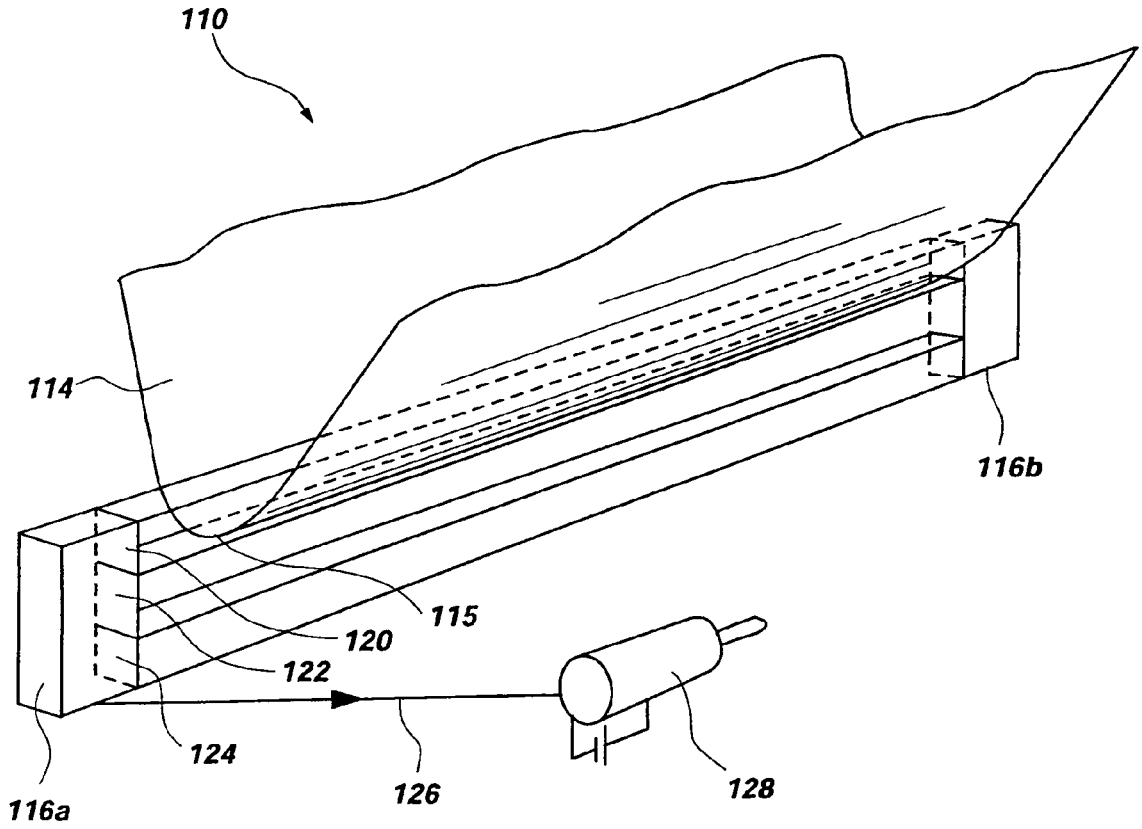
FIG. 2 is an expanded, perspective view of a portion of one embodiment of an unwind subsystem of the present invention.

Referring now to FIG. 2, there is shown an expanded perspective view of a section of the unwind subsystem 110. As illustrated, the fabric 114 is draped, where an apex 115 of the fabric 114 hangs between two fabric level sensors 116*a* and 116*b*. As illustrated, the fabric level sensor 116 includes three zones, a feed zone 120, a no action zone 122, and a stop feed zone 124. As the fabric 114 unwinds from the fabric roll 112, the apex 115 of the draped fabric 114 may travel vertically from one zone of the fabric level sensor 116 to another zone. For instance, if the speed of the unwinding of the fabric 114 exceeds the uptake of the fabric 114 by the UFTCS 10, the apex 115 of the fabric 114 will move to a lower zone.

As illustrated in FIG. 2, if the uptake of the fabric 114 by the UFTCS 10 slows, the apex 115 of the fabric 114 will move downward from the feed zone 120 to the no action zone 122, and maybe even into the stop feed zone 124. If the apex 115 reaches the stop feed zone 124, the optical fabric sensor 116 stops sending feed fabric signals, indicated by arrow 126 to a fabric advance motor 128. In turn, the fabric advance motor 128 quits unwinding the fabric roll 112. As illustrated, since the apex 115 of the fabric 118 is in the feed zone 120, the optical fabric sensor 116 instructs the fabric advance motor 128 to unwind the fabric roll 112.

As illustrated, the optical fabric level sensor 116 is an infrared sensor, but it is understood that any type of sensor that performs functions the same as the optical fabric level sensor 116 described herein is encompassed by the present invention. The unwind system 110 may also be configured to detect differential side-to-side imbalances of the fabric 114, such that if one side of the fabric 114 advances faster than the other side of the fabric 114, the unwind system 110 corrects for the effect by differentially advancing the fabric roll 112.

The illustrated unwind system 110 does not create a significant variation in a back tension force applied to the draped fabric 114. Rather, variable back tension force on the draped fabric 114 in the illustrated embodiment is due to the weight of a few inches of draped fabric 114 between the optical fabric level sensors 116*a* and 116*b* which can be considered as negligible. In contrast, when standard dancer bars are used to sense the unwinding of the fabric roll 112, changes in weight vector forces applied to the fabric 114 can cause substantial back tension variations in the fabric 114. These back tension variable forces create scaling artifacts in a finished printed fabric when the printed fabric reverts to a relaxed state. By using the optical fabric level sensors 116*a* and 116*b* to provide the control signals for the unwinding of the fabric 114 from the fabric roll 112, the resultant draping of the fabric 114 relaxes the fabric 114 and allows the draped fabric 114 to dissipate the winding and storage stresses induced in the fabric 114 as the fabric 114 is rolled on the fabric roll 112, as previously described herein with reference to the relaxation zone 113.

Figure 3:
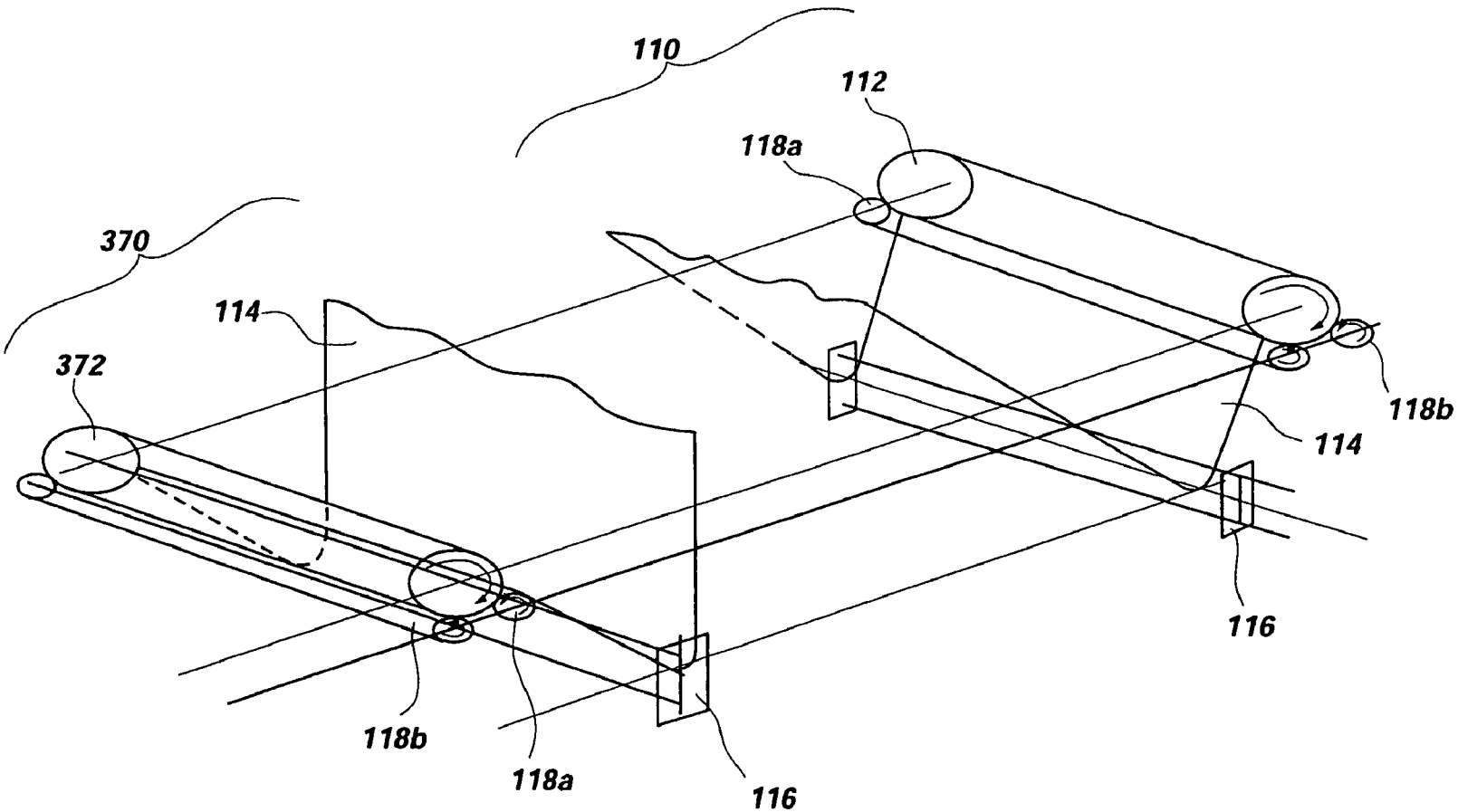
FIG. 3 is a partial, perspective view the unwind subsystem of FIG. 2 and a rewind subsystem substantially similar to the unwind subsystem of an embodiment of the present invention.

Referring now to FIG. 3, there is shown a perspective view of the unwind subsystem 110 of FIG. 2 and a rewind subsystem 370 of the UFTCS 10. As illustrated, the unwind subsystem 110 is substantially the same as the rewind subsystem 370, except the unwind subsystem 110 operates in a direction opposite to that of the rewind subsystem 370. A finished printed roll 372 of the rewind subsystem 370 is substantially the same as the fabric roll 112 of the unwind system 110. The rewind subsystem 370 and unwind subsystem 110 also include substantially identical rollers 118*a*, 118*b* or 118*c*, and fabric level sensors 116.

As previously discussed herein with reference to the relaxation zone 113 of the unwind subsystem 110, the fabric 114 relaxes and dissipates winding stresses induced in the fabric 114 during the rolling and storing of the fabric roll 112. Furthermore, the condition of the fabric 114, such as its moisture content and temperature, equilibrate to the ambient conditions surrounding the system in the relaxation zone such that the fabric 114 is in the same ambient environment as a printing subsystem 250 when a pattern is printed on the fabric 114. By allowing the fabric 114 to equilibrate to the ambient environment where the printing system is located, the characteristics of the fabric 114 will vary less during the printing process.

The UFTCS 10 of FIG. 1 is able to feed about 20 linear meters of fabric 114 per hour using a 0.85" inch thermal ink-jet (TIJ) scanning writing system in the print subsystem 250. It is understood that other ink-jet systems can also be used interchangeably in the place of a scanning head thermal Ink-Jet system. It will be appreciated by those of ordinary skill in the art that the printing of patterns on fabrics is substantially slower than the printing of patterns on paper because the ink flux required for printing fabrics is significantly higher than the ink flux used on paper, i.e., by factors of two to ten times depending on the type of fabric and the specific pattern being printed. Therefore, the time required for the fabric 114 to pass through the relaxation zone 113 of the UFTCS 10 provides ample opportunity for the fabric 114 to relax, and equilibrate to the ambient environment of the UFTCS 10 after the fabric 114 exits the unwind zone 110.

Although not illustrated, the unwind subsystem 110 may also include a small diameter rod of various weights which may be used to add additional back tension to the draped fabric 114, if necessary. The small diameter rod may be placed in the cradle created by the apex 115 of the draped fabric 114. It will be further appreciated that the angle of the fabric drape in the material delivered to the conditioning zone 100 should be as acute as possible, such that variations in the back tension force applied to the fabric 114 due to rod weight would not vary by more than about 2 to 3 percent.

As known in the art, fabrics have an almost infinite variability in their characteristics due to factors including, but not limited to, the type of fiber used in the fabric, the weight of the fiber, the different blend of material used in the fiber, the weave pattern used to create the fabric, the environmental conditions existing at the time of printing, the pre-treatments used on the fabric, the surface finish of the fabric, the varying moisture contents of the fiber in the fabric, the non-linear behavior of woven materials, and the differences in fabric behavior when wet or dry. Therefore, since these fabric variations are usually present in the entire length of the fabric 114 of the fabric roll 112, the continually changing fabric variations can be a major cause of defects and pattern variation in all fabric printing systems. Accordingly, it is important in any fabric printing system, especially digital printing systems, to acquire as much information as possible about various multi-dimensional force displacement characteristics inherently present in the fabrics in order to accurately advance the fabric through the printing system. Once information about these characteristics is gathered, the information may then be used to adjust operating parameters of a fabric advance subsystem in order to accommodate for the aforementioned fabric variations.

One type of device that may be used in the characterization of the fabric 114 is a skewed driven roller. Skewed driven rollers are well known to those of ordinary skill in the art of textile printing and may be used to guide and stretch the fabric 114. As known in the art, skewed rollers are set at an angle with respect to a web of the fabric and are capable of inducing various degrees of stretch, and translation in a fabric in both X and Y directions.

Referring again to FIG. 1, the UFTCS 10 of the present invention characterizes the fabric 114 with a fabric characterization 130*a* and tension control subsystem 130*b*. As illustrated in this particular embodiment, a first fabric characterization and tension control subsystem 130*a* is illustrated just above the optical fabric level sensor 116 in the path of the fabric 114 and is used to modify multi-dimensional force displacement characteristics of the fabric 114. The fabric characterization and tension control subsystem 130*a* includes a set of two skewed driven rollers 132 and a charge couple device (hereinafter "CCD") array 134.

The skewed rollers 132 are used to stretch the fabric 114 in a controlled manner and induce a wide range of multi-directional distortion conditions in the fabric 114. Although skewed driven rollers 132 are used in the illustrated embodiment, it will be appreciated by those of ordinary skill in the art that other devices that perform functions the same as, or equivalent to, the skewed driven rollers 132 described herein are meant to be encompassed by the present invention. For instance, a segmented individually driven belt system (not shown) may also be used.

Figure 4:
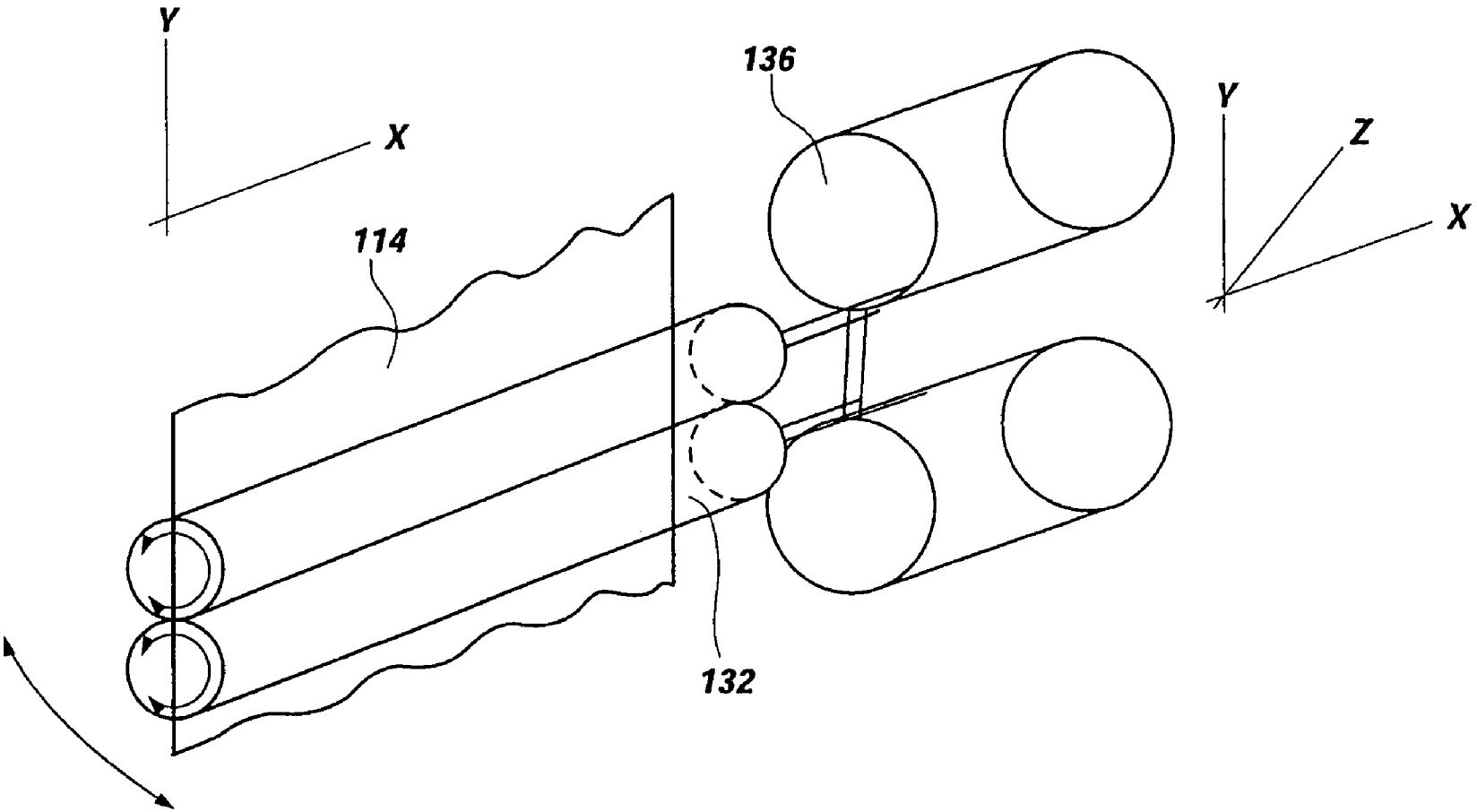
FIG. 4 is a perspective view of skewed rolls and drive motors of the skewed rollers of a first embodiment of a fabric characterization and tension control subsystem of the present invention.

Referring now to FIG. 4, there is shown an expanded, perspective view of the skewed driven rollers 132 of the fabric characterization 130*a* and tension control subsystem 130*b* of FIG. 1. As illustrated, the skewed drive rollers 132, or guiding tensioning active rollers, are used to stretch the fabric 114 in both X and Y directions in a predetermined and preset displacement, range, and amplitude. Drive motors 136 that control the skewed rollers 132 are also illustrated wherein the drive motors 136 are configured to move in X, Y and Z directions such that the skewed rollers 132 may be used to stretch the fabric 114 in both the X and Y directions, as determined by the set angle of the rollers with respect to the fabric web. As the fabric 114 is stretched, a weave pattern frequency of the fibers within the fabric 114 changes and is observed with the CCD array 134 (FIG. 1). The weave pattern frequency of the fibers in the fabric 114 is monitored as a change in a function of the induced deformation patterns induced into the fabric 114 by the skewed rollers 132. In the illustrated embodiment, three or five area CCD arrays 134 may be positioned across the web of the fabric 114 and used to monitor the weave pattern frequency change as a function of the induced tension in both the X and Y directions.

Using the fabric weave information gathered by the CCD array 134, and low angle lighting, a fundamental frequency content of the fabric weave may be derived as a function of the deformations induced in the fabric 114. The signals from the CCD array 134 may then be assigned appropriate numerical values that would be proportional to the frequency content of the fabric weave. Using these numerical values, a Fast Fourier Transform algorithm may be used to derive the fundamental frequency content of the fabric weave as a function of the X and Y deformations introduced in the fabric 114. Since the frequency content of threads in the fabric 114 is inversely proportional to the tension in the fabric 114, the characteristic tension may be derived for any given fabric 114 present in the UFTCS system 10 during the set-up steps of the print job. Also, since a fabric characterization and tension control subsystem 130 may be introduced at various locations within the UFTCS system 10, the characteristics of the fabrics 114 may be determined and compensated for in real time throughout the print job. In this manner, since another fabric characterization and tension control subsystem 130*b* is implemented in the UFTCS system 10 before a fabric control subsystem 210, the predetermined and preset displacement range and amplitude functions that were previously characterized for the fabric 114 may be accurately induced into the fabric 114 before the fabric 114 is introduced into the fabric control subsystem 210.

The use of the characterization and tension control subsystems 130*a* and 130*b* allows the machine operator of the UFTCS 10 to set optimal tension derived in the setup of a print job, and to further allow the machine operator to continuously monitor and control the parameters for the given print job, with respect to changing environmental conditions and fabric types. The machine operator is also able to control tension induced artifacts i.e., image scaling and distortion, that may be introduced into the printed fabric 114 during the set-up steps.

It will be appreciated that the characterization and tension control subsystems 130*a* and 130*b* described herein may be useful in traditional textile printing systems because the traditional printing systems, and also address other fabric non-linearity issues. In traditional printing systems, a significant savings in an amount of fabric that is wasted due to these variations is minimized by reducing the amount of "scrap yardage" produced by distorted images printed due to the aforementioned non-linear behaviors of fabrics.

As previously described herein, the mechanical behavior of any given fabric is directly coupled to and is a fundamental function of the weave, thread type, moisture content, temperature, tension strain in both the X and Y directions, pretreatments used, and coating weight used on the fabric. Therefore, it is desirable to have a characterization and tension control subsystem 130*b* before the fabric 114 enters a fabric motion control zone 210 and the printing subsystem 250 because these subsystems are highly sensitive to the real time mechanical variations of the fabric.

In addition to ascertaining characteristics of the fabric 114 after the fabric 114 is unwound from the fabric roll 112, the fabric 114 may also need to have creases removed, the location of tread knots and irregularities ascertained in order to avoid printing on those areas, the pen-to-media distance adjusted in order to miss the knots. Accordingly, the UFTCS 10 of FIG. 1 also includes a tread knot, irregularity, and crease detection subsystem 150 and a fabric drying and conditioning subsystem 170. These subsystems include components used to de-crease and iron the fabric 114 before a pattern is printed thereon. After the fabric 114 is de-creased and ironed, and before printing begins, the fabric 114 should be at an optimal moisture content and temperature range. It will become apparent from the following description that since the fabric 114 is deformed in many directions to ascertain a minimum crease condition of the fabric 114, the de-creasing and ironing of the fabric 114 may also occur within, or in close proximity, to the fabric characterization and tension control subsystem 130 such that these processes are most efficiently accomplished at the same time.

As previously discussed herein, traditional processes used to manufacture fabric in the textile industry results in the fabric 114 on the fabric roll 112 to include many creases and surface irregularities. These irregularities may cause head crashes of the ink-jet printer used in the print and printer control zone 200 or may cause other technical/practical problems in the UFTCS 10. Additionally, fabric characteristics for the same type of fabric may vary from fabric roll to fabric roll. Accordingly, these creases and irregularities need to be constantly monitored and removed along the flow of the fabric 114 by steaming and ironing the fabric 114 before the fabric 114 passes to subsystems downstream in the UFTCS 10. Furthermore, since fabric that is wound close to the core of the fabric roll 112 is not exposed to the same environmental conditions as the outer layers of fabric 114 of the fabric roll 112, variations in fabric 114 will change as the fabric 114 in a single fabric roll 112 passes through the UFTCS 10.

Figure 5:
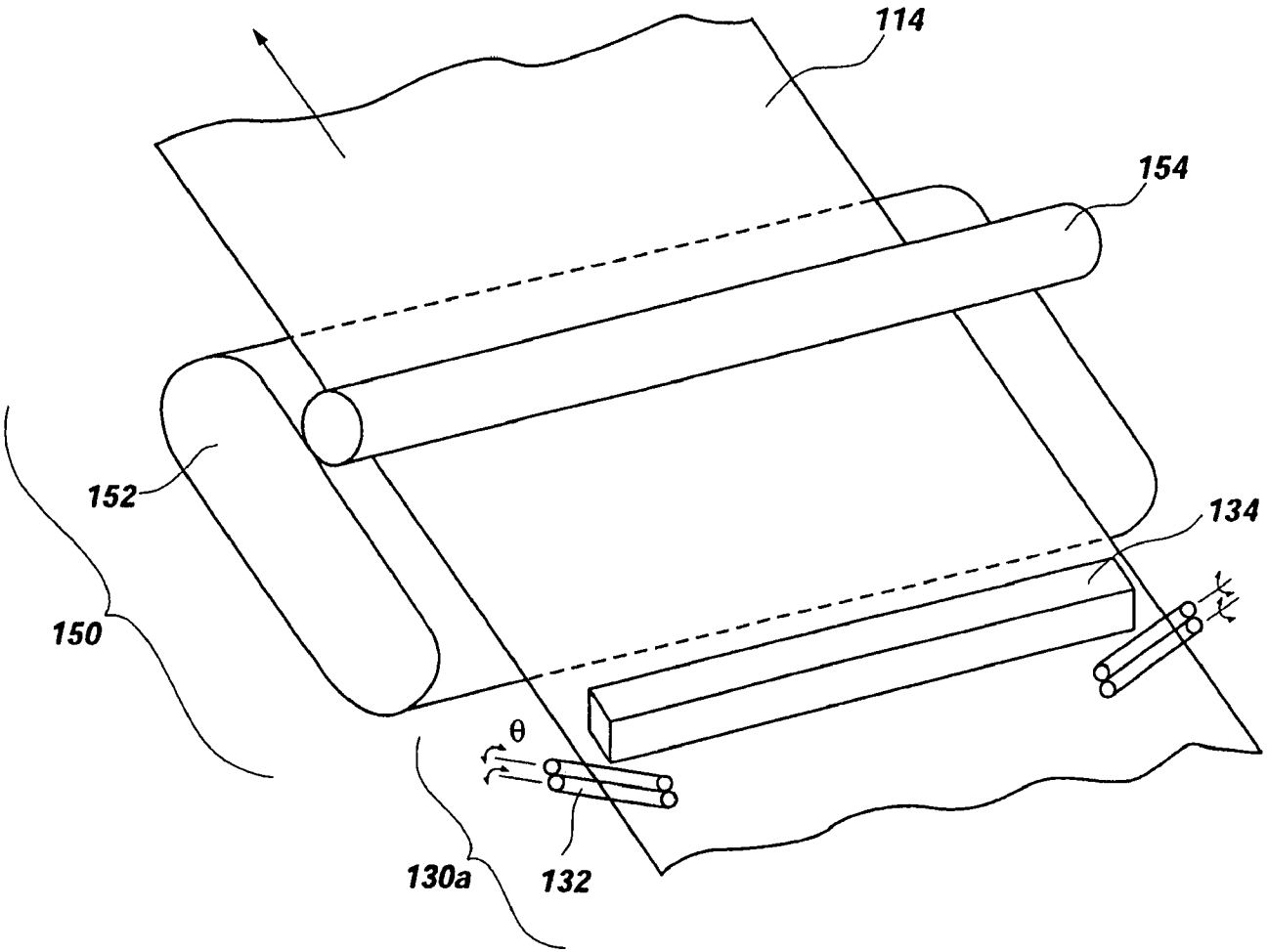
FIG. 5 is a perspective view the fabric characterization and tension control subsystem of FIG. 4 in relation to a steam table and ironing roller of an embodiment of the present invention.

Referring now to FIG. 5, there is shown an expanded perspective view of a first embodiment of the fabric characterization and tension control subsystem 130 located just ahead of components used in the irregularity detection and removal subsystem 150. As illustrated, the irregularity detection and removal system 150 includes a steam table 152 and an ironing roller 154. Once the fabric 114 is characterized by the fabric characterization and tension control subsystem 130, the fabric 114 is moved in a direction illustrated by arrow 14. The fabric 114 crosses the steam table 152 and is ironed with the ironing roller 154 to remove wrinkles and creases. It will be apparent that steam tables 152 and ironing rollers 154 are well known in the art. Accordingly, any steam table 152 and ironing roller 154 that performs functions the same as, or equivalent to, the steam table 152 and ironing roller 154 described herein are meant to be encompassed by the present invention.

Figure 6:
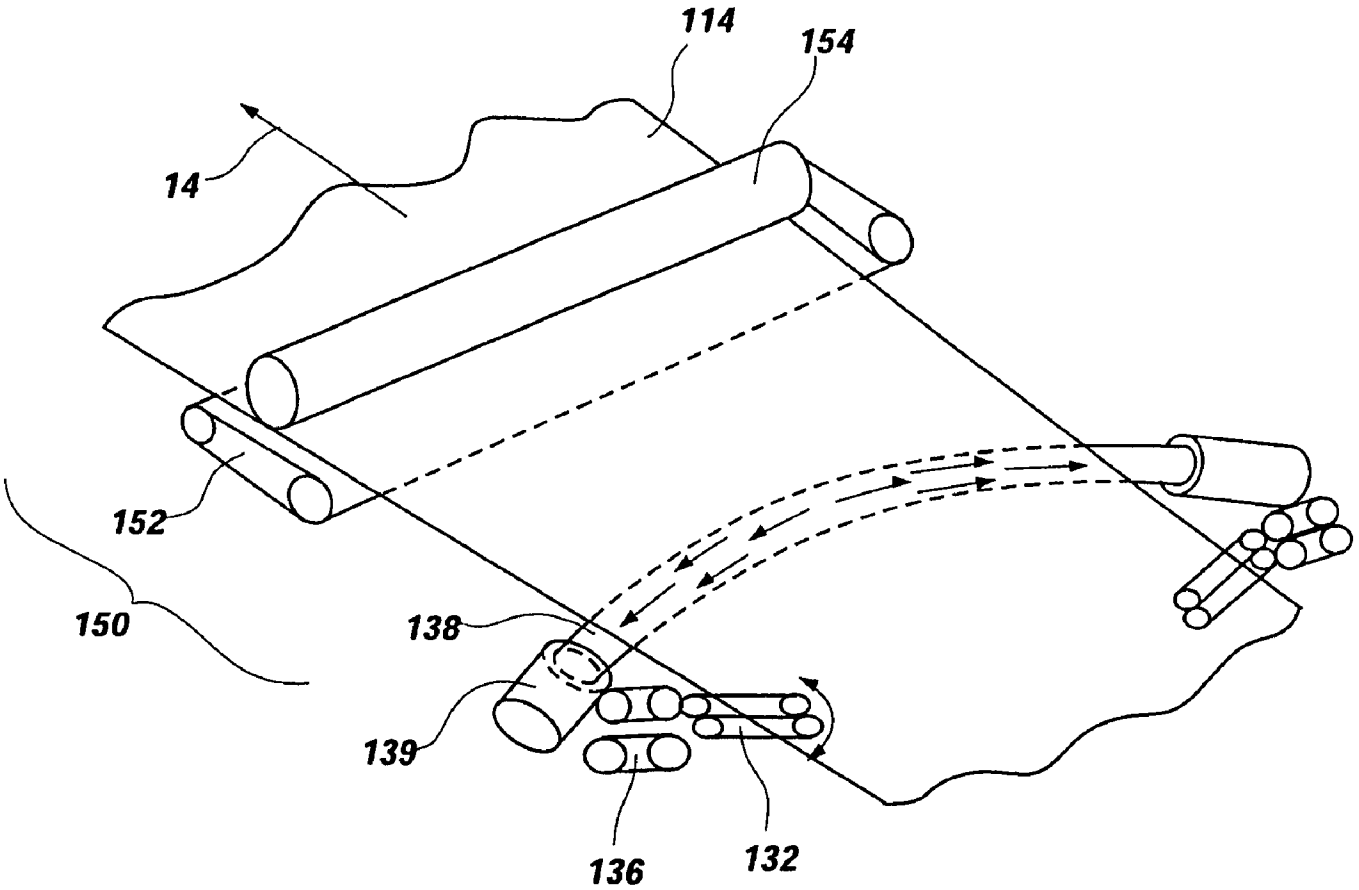
FIG. 6 is a perspective view of a second embodiment of a fabric characterization and tension control subsystem in relation to a steam table and ironing roller of the present invention.

Referring to FIG. 6, there is shown an expanded perspective view of a second embodiment of the fabric characterization and tension control subsystem 130 in relation to the irregularity detection and crease removal subsystem 150. As illustrated, the fabric characterization and tension control subsystem 130 includes skewed rollers 132 and drive motors 136 to drive the skewed rollers 132. Also included are a bowed roller 138 and a bowed roller drive motor 139. The bowed roller 138 is used to remove soft creases and provide a light cross-web tension to the fabric 114. Once the soft creases are removed, the fabric 114 may be stretched in multiple directions by the skewed rollers 132 and bowed roller 138 before the fabric 114 is transported to the steam table 152.

Additionally, the skewed rollers 132 may provide web guidance of the fabric 114 when used in conjunction with the CCD array 134, as illustrated in FIG. 5. It will be appreciated that depending on the type of fabric 114 in the UFTCS 10, the fabric characterization and tension control subsystem 130 may utilize only skewed rollers 132, only a bowed roller 138, or a combination of skewed rollers 132 and the bowed roller 138, as illustrated in FIG. 6. Although FIG. 6 illustrates the use of one bowed roller 138, it will be apparent that more than one bowed roller 138 may be used in the UFTCS system 10 without departing from the spirit of the present invention.

Also, the bowed roller 138 may be located before or after the skewed rollers 132 and still be encompassed by the present invention.

Referring again to FIG. 1, the irregularity detection and removal system 150 may also include a CCD camera 156 that may used to observe irregularities, such as crease patterns, in the fabric 114. Once the fabric 114 is stretched in multiple directions with the skewed rollers 132, the CCD camera 156 may be used in conjunction with a multiple time phased low angle lighting system (hereinafter "low angle lighting system") (shown in FIG. 7A). The low angle lighting system is used to illuminate the fabric 114 such that shadows are cast by raised creases, or other irregularities, on the surface of the fabric 114. The CCD camera 156 may also be used to gather crease vector information from the fabric 114. Once the crease vector information is known, antivector forces can be introduced into the fabric 114 with skewed rollers 132 to remove the creases resulting from the crease vectors and flatten the fabric 114. As known in the art, the skewed rollers 132 may be used to introduce force vectors perpendicular to the creases in the fabric 114 to remove the creases. In an alternative embodiment, differential sectioned drive belts (not illustrated) may be incorporated into the UFTCS 10 to remove creases from the fabric 114.

When the surface of the fabric 114 is illuminated with the low angle lighting system, one or more shadow(s) are cast by any given crease or surface irregularity on the surface of the fabric 114. By observing a contrast in light and dark areas on the surface of the fabric 114, the crease condition of the fabric 114 may be ascertained. For instance, a minimum crease condition of the fabric 114 is observed as a low amount of contrast on the surface of the fabric 114 because a shallow crease will not cast a large shadow area. Alternatively, if many creases are present on the surface of the fabric 114, then a plurality of shadows are cast which can be observed as having a higher contrast ratio. The contrast may be measured using the CCD camera 156. As known in the art, CCD cameras 156 observe pixels of information in a field of view. An average contrast on the surface of the fabric 114 may be determined by averaging the output value of each of the CCD pixels over the field of view of the fabric surface. A determination of the lowest crease condition of the fabric 114 in the UFTCS 10 is achieved by averaging the output value of each CCD pixel in each of the camera frames, while the fabric is stretched in a predetermined stretch pattern. A highest average pixel value for the vectors of force introduced into the fabric 114 may be ascertained such that an optimal stretch condition is determined for each fabric 114. The highest average pixel output condition corresponds to the lowest contrast condition and represents a smooth state of the fabric 114 with the minimum crease condition. Larger shadows are created when the light source is oriented in a low angle in relation to the fabric 114, thus amplifying the shadow of a crease.

Figure 7A:
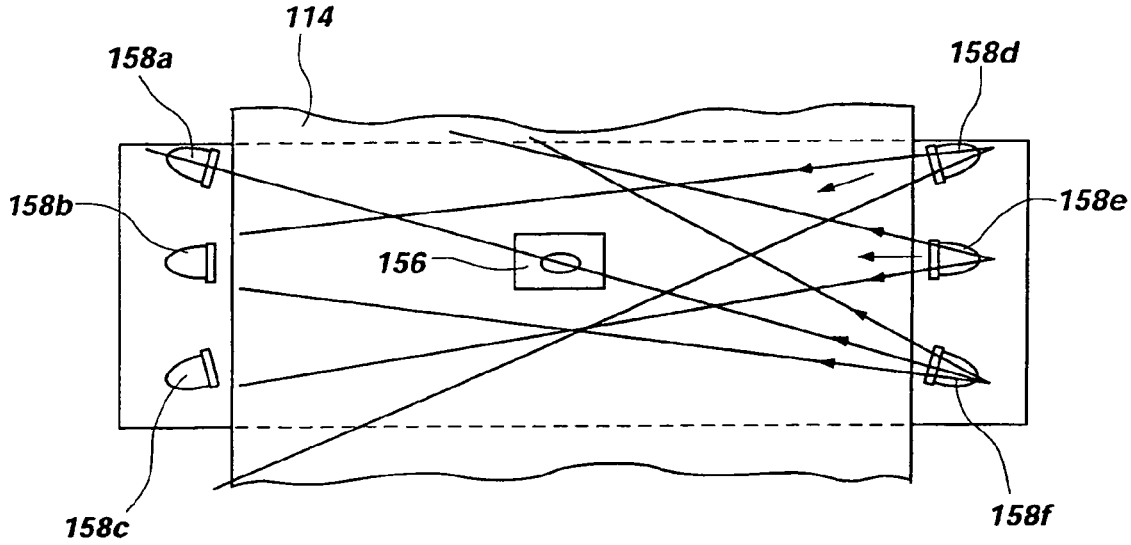
FIG. 7A is a schematic representation of one embodiment a low angle lighting system used in one embodiment of a crease & irregularity detection subsystem embodying teachings of the present invention.

Referring now to FIG. 7A, there is shown a schematic representation of the CCD camera 156 of FIG. 6 positioned to observe a fabric 114. A plurality of light sources 158 making up the low angle lighting system is illustrated as illuminating the surface of the fabric 114. The light sources 158*a* through 158*f* are arranged such that light is cast upon the surface of the fabric 114 from various angles such that the CCD camera 156 observes multiple shadow patterns caused by the crease patterns, or other surface irregularities present on the surface of the fabric 114.

Figure 7B:
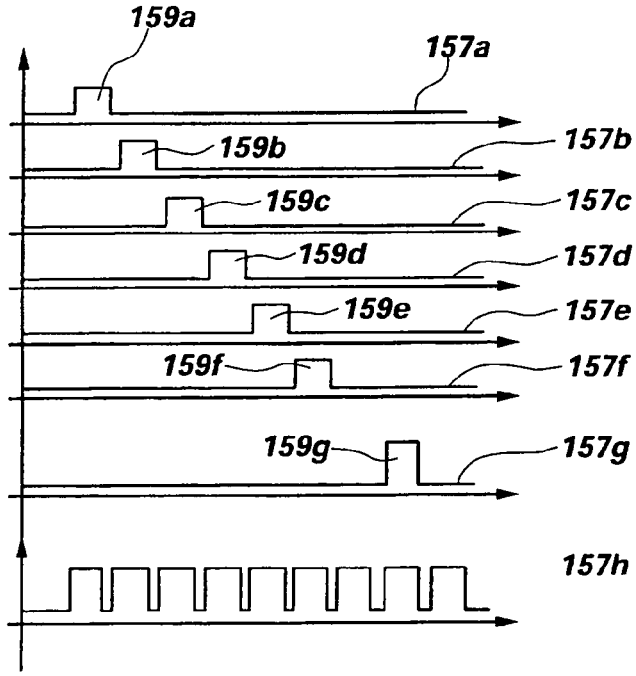
FIG. 7B is a diagram depicting an illumination sequencing scheme used in one embodiment of the present invention in the crease & irregularity detection and removal subsystem of FIG. 7A.

FIG. 7B illustrates the timing diagram for strobing of the light sources 158*a* through 158*f*. For instance, timing diagram 157*a* represents the on time of the light source 158*a*, line 157*b* represents the on time of the light source 158*b*, etc. Rectangular waveforms 159*a* through 159*f* represent pulses of light generated from each light source 158*a* through 158*f*. Thus, the light sources 158 are switched sequentially onto the surface of the fabric 114 in a time-dependent manner wherein 158*a* pulses first, then 158*b*, etc. It will be apparent that although there are six light sources 158 illustrated, there may be any number of light sources. Line 157*h* shows each light source 158 in the plurality pulsing simultaneously to calibrate the CCD camera 156. The timing of the CCD camera 156 image-capture cycles will be synchronized with the strobing of the light sources 158. Calibration may be accomplished at any time, such as when a different type of fabric 114 is introduced into the UFTCS 10, to achieve the best print quality.

If a crease is present on the surface of the fabric 114, the low angle light source 158 casts a shadow on one side of the crease, while the other side of the crease is illuminated. Thus, a pixel of the CCD camera 156 in the field of view of the shadow is sensed as a dark output, while another pixel of the CCD camera 156 in the field of view on the other side of the crease is sensed as a light output. Using the light and dark output information gathered by the CCD camera 156, the CPU of the UFTCS 10 may be used to ascertain the position of the crease on the surface of the fabric 114. In order to obtain the average contrast, the CCD camera 156 is periodically calibrated for both full white and full dark output values for each pixel of a CCD chip within the CCD camera 156. The calibration enhances a dynamic range of the CCD camera, accounts for the degradation of the light source, and enhances the fidelity of the pixels of information. Analysis of the shadow pattern created by the light and dark outputs observed by the CCD camera 156 may be accomplished in any manner known in the art.

Referring again to FIG. 1, by observing and recreating the minimal crease condition, the skewed rollers 132 may be used to remove creases sensed by the CCD camera 156 to make the fabric 114 as flat as possible before being presented to the steam table 152 and ironing roller 154. Once the fabric 114 is presented to the ironing roller 154, the fabric 114 is ironed substantially flat prior to the fabric 114 entering the fabric drying and conditioning subsystem 170. In order to iron the fabric 114 to a substantially flat condition, steam from the steam table 152 is delivered to the fabric 114. As known by those of ordinary skill in the art, the severity of a crease in the fabric 114 dictates an amount of steam required to iron out the crease because there is a fundamental relationship between the severity of creases and the amount of steam required to remove the crease. Thus, a moisture content of the fabric 114 may vary depending on the severity of the crease, and thus the amount of steam delivered to the fabric 114 to remove the crease.

Figure 8:
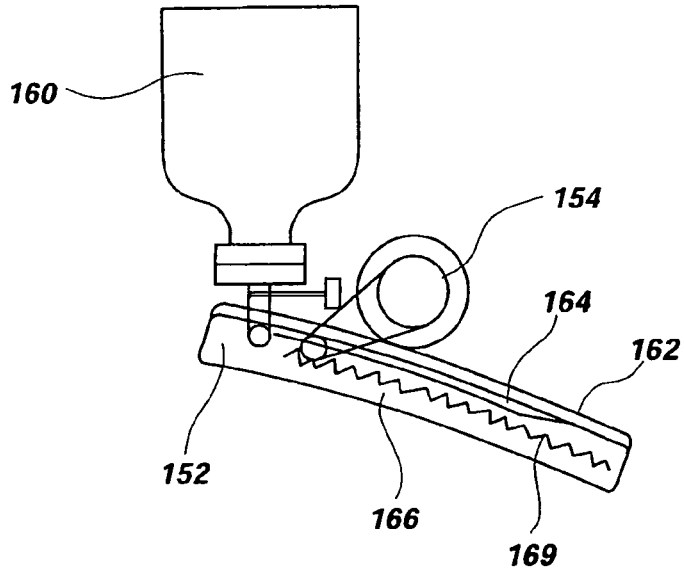
FIG. 8 is cross-sectional view of one possible configuration of a steam table and ironing roller of one embodiment of a crease removal subsystem of one embodiment of the present invention.

Referring now to FIG. 8, there is shown a cross sectional view of the steam table 152 and ironing roller 154 of the present invention. A source of water used to generate the steam in the steam table 152 should be distilled/de-ionized water such that mineral build up does not occur on the steam table 152. As illustrated, a container 160 of distilled/de-ionized water can be utilized such that a water line hookup is not required for use of the UFTCS 10. The steam table 152 also includes a mesh 162 for transferring the steam from the steam table 152 to the fabric (not illustrated), a steam channel 164, a heat capacitor 166, and heating elements 169 for the steam generation.

Figure 9:
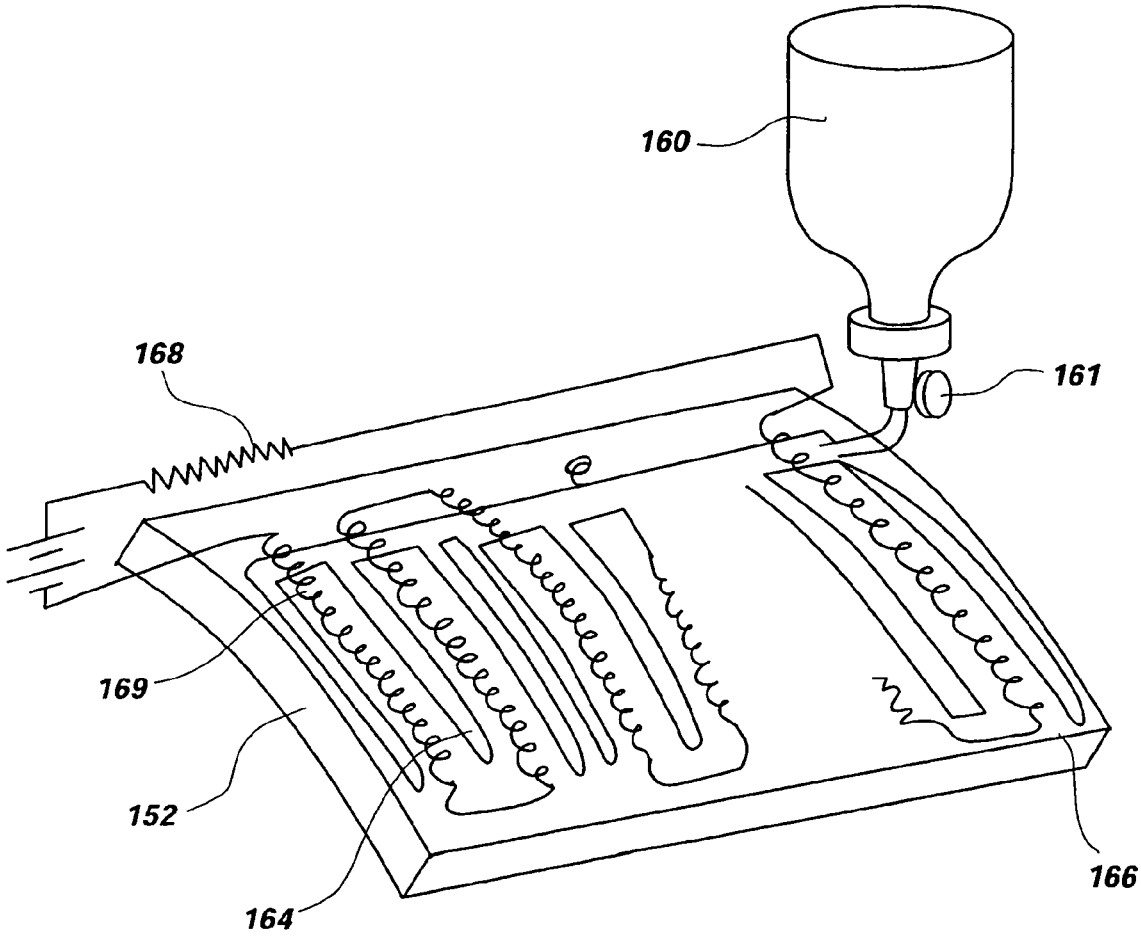
FIG. 9 is a perspective view of the steam table in one embodiment of the present invention shown in FIG. 8.

Referring now to FIG. 9, there is shown a perspective view of the steam table 152 of FIG. 8 (ironing roller not illustrated). Also illustrated in FIG. 9 is a water valve 161 for controlling the flow of the water from the water container 160, a heat control element 168, and water channels 164. It will be appreciated that since many standard components are known in the art for the production of steam tables, that many possible embodiments of the steam table 152 exist and the invention is not meant to be limited by the steam table 152 configuration depicted. In an alternative embodiment, a steam re-circulation system (not illustrated) may be added to the UFTCS 10 to enhance the energy/water usage efficiency of the UFTCS 10, thus making the UFTCS more energy efficient and less costly to operate.

To accommodate for the widest range of surface irregularities and creases that may be present in the fabric 114, an operator of the UFTCS 10 may adjust various set up parameters for each fabric 114 including, but not limited to, the steam temperature used to remove creases, the amount of steam transferred to the fabric 114, an amount of pressure applied to the fabric 114 by the ironing roller 154, and the amount of tension introduced in the fabric 114 by the fabric characterization and tension control subsystem 130. For ease of use, the set up parameters may be stored in a UTFCS 10 controller module (not shown) such that the various set up parameters are available for easy reload for repeating particular print jobs using similar fabrics and fabric conditions.

In addition to detecting creases in the fabric 114, components of the irregularity detection and removal subsystem 150 may be used to detect other types of defects, such as knots. As known in the art, during the process of weaving fabric, loom operators tie knots at the end of one of the thread bobbins to start a new bobbin of thread. As the fabric 114 is woven, the knots go through a loom and are woven into the finished fabric. Some of the knots and other irregularities present in the fabric may protrude higher than a distance between the fabric 114 and a pen used to print a pattern in the print subsystem 250. When a knot or irregularity is too large to pass between the fabric 114 and the pen, the pen of a print head in the print subsystem 250 may be damaged. To protect the print heads, the knots or irregularities may be detected before the print zone and indexed over, such that the print heads will be protected from impact with them and damage to the print head can be avoided.

In the illustrated UFTCS 10 of the present invention, knots and other irregularities may be detected in the irregularity detection and removal subsystem 150 in a manner similar to the detection of creases as previously described herein. The CCD camera 156 and low angle lighting system may be used to scan for knots and other irregularities that are larger than, for example, 1 mm in height, width and length. Generally, the CCD pixel values are compared as previously described herein with reference to the detection of creases. When a knot or other irregularity is detected, the localized CCD pixel value corresponding to the reflection of the low angle light off of the fabric 114 will decrease. When the irregularity detection and removal subsystem 150 detects the knot or other irregularity, the data corresponding to the irregularity may be fed to the printer subsystem 250 such that the printer subsystem 250 may be directed to skip printing a swath of fabric 114 before and after the knot, thus avoiding costly replacement of the print heads.

Figure 10:
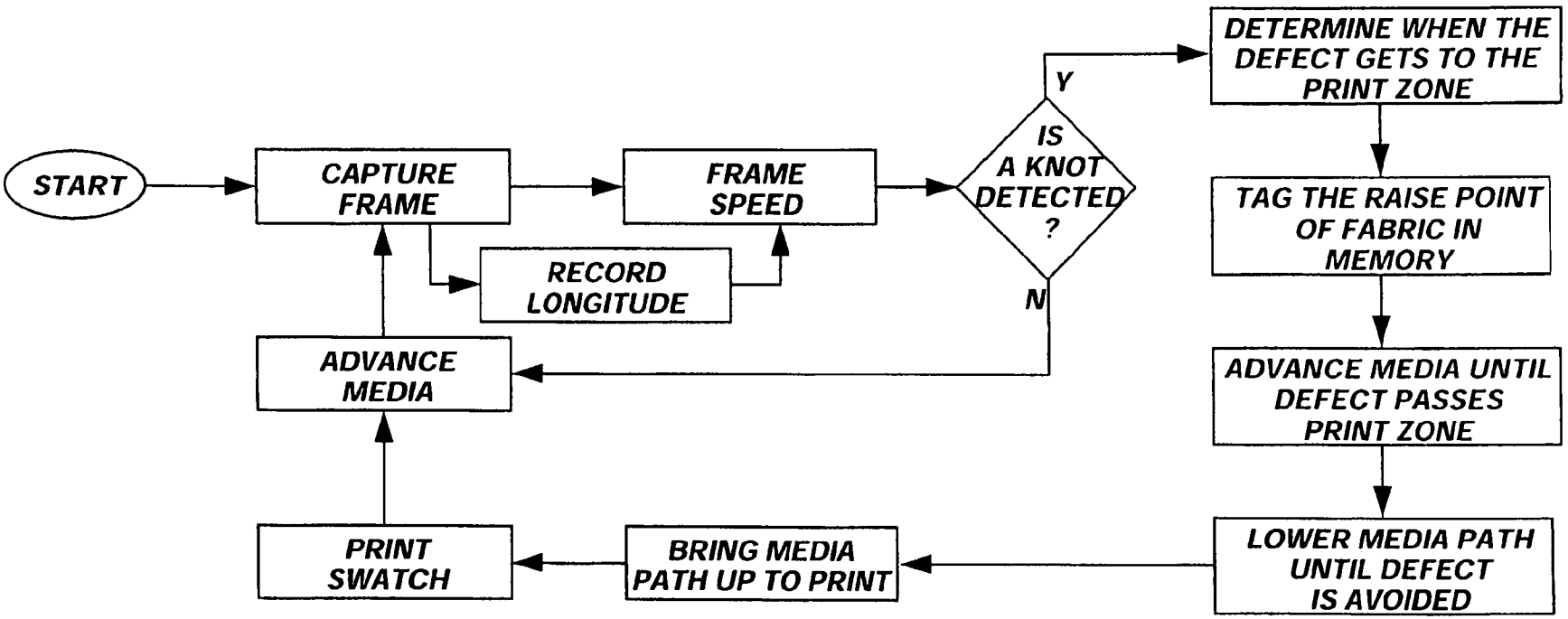
FIG. 10 is a flowchart of one embodiment, and an algorithm used to detect irregularities, and based upon the detection data, adjust the pen-to-fabric spacing so that damage to the print heads can be avoided, embodying teachings of one embodiment of the present invention.

Referring now to FIG. 10, there is illustrated an algorithm flow chart. The algorithm is used to process values obtained from the CCD camera 156 and may be performed by the CPU of the UFTCS 10. Data generated using the illustrated algorithm is used to notify the print subsystem 250 when to skip printing in order to miss the knot or irregularity. Although the algorithm indicates that the fabric path is moved such that the defect is avoided by the print heads, in an alternative embodiment, the print heads are raised to avoid the defect contacting the print head.

Figure 11:
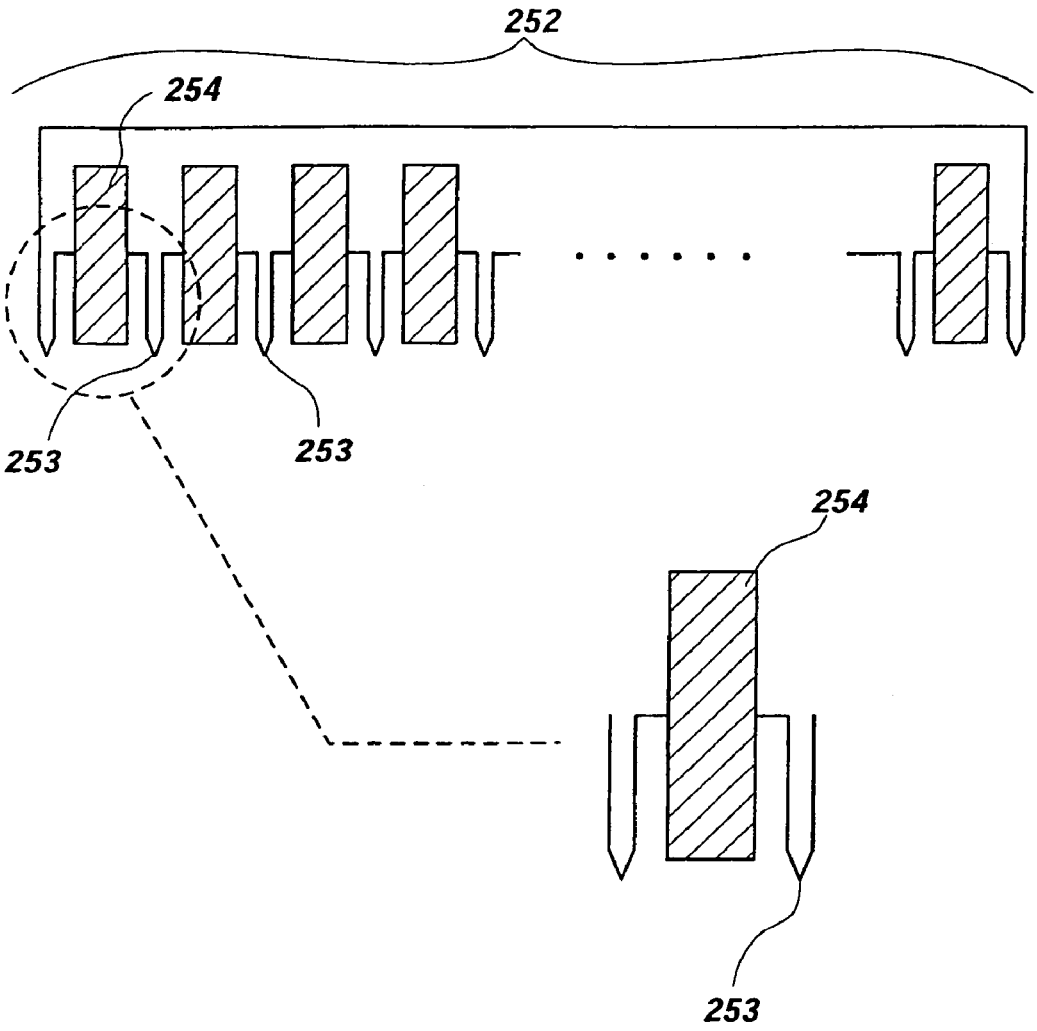
FIG. 11 is a schematic representation of one possible configuration of print head carriage, used in one embodiment of a print subsystem of the present invention that protects the inkjet element from intimate contact with knots and other fabric defects.

In addition to protecting print heads from damage by locating and subsequently avoiding knots and irregularities in the fabric, the print subsystem 250 of the present invention may also be configured with a pen head construction that helps minimize potential damage to the pen heads. Referring now to FIG. 11, there is shown a schematic representation of a configuration of pens within a print head carriage employing teachings of the present invention. As illustrated, pens 254 inserted in a print head carriage 252 have rigid fins 253 located between the pens 254. Therefore, if a tread knot or other irregularity is missed by the detection system and works its way into the print zone, the rigid fins will prohibit them from striking the print head and, hence, damaging the sensitive assembly. Referring again to FIG. 1, the illustrated design of the print subsystem 250 also helps prevent damage to the print heads 252 because no hard backing is present underlying the print subsystem 250. Rather, as illustrated, the region directly underlying the print subsystem 250 that the pens 254 pass over, allows the fabric 114 to float freely and stretch. Therefore, if a knot passes under the print head 252 and contacts one of the pens 254, the unbacked fabric 114 under the print head 252 may bow downwards and not injure the pen 254.

Although the irregularity detection and removal subsystem 150 and specific configuration of the pens 254 in the print subsystem 250 may help prevent damage to the print heads 252, the described subsystems do not solve print defect issues due to imperfections in the fabric 114. As known to those of ordinary skill in the art, print defects of one kind or another occur when a pattern is printed onto the fabric defect area in the fabric 114. Therefore, components within the fabric characterization and tension control subsystem 130, the irregularity detection and removal subsystem 150, the fabric drying and conditioning subsystem 170, the fabric control subsystem 210, and the color consistency densitometry subsystem 270 may individually, or collectively, be used to ensure that the number and types of print defects are minimized.

For instance and referring to FIG. 1, once the fabric 114 exits the irregularity detection and removal subsystem 150, the fabric 114 has a high moisture content from the steam transferred to the fabric from the steam table 152. The excess water in the fabric 114 needs to be removed from the fabric 114 such that the fabric 114, or an ink receptive layer of the fabric 114 (not shown), are at an optimal moisture content before the pattern is printed on the fabric 114 in the print subsystem 250. Accordingly, the fabric drying and conditioning subsystem 170 is used to precondition the fabric 114 prior to printing.

The fabric drying and conditioning subsystem 170 includes an air flow means 172, such as a blower in combination with a heater. In the illustrated embodiment, the blower and the heater are on different controls, such that the blower and heater can be adjusted independent from each other, thus providing operators of the UFTCS 10 a large degree of freedom to accommodate various moisture and environmental conditions in the fabric 114. In an alternative embodiment, the CPU operatively connected with the UFTCS 10 may be used to monitor and adjust the moisture and environmental conditions in the fabric 114.

As previously discussed herein, placement of the fabric drying and conditioning subsystem 170 before the print subsystem 250 allows the fabric 114 to be at an optimal moisture content and temperature range for printing of the pattern on the fabric 114. However, since the fabric 114 is de-creased before being ironed, the fabric 114 is deformed in many directions in an effort to ascertain the minimum crease condition. This deformation of the fabric 114 induces strain conditions in the fabric 114 which may need to be removed before the pattern is printed on the fabric 114.

Figure 12:
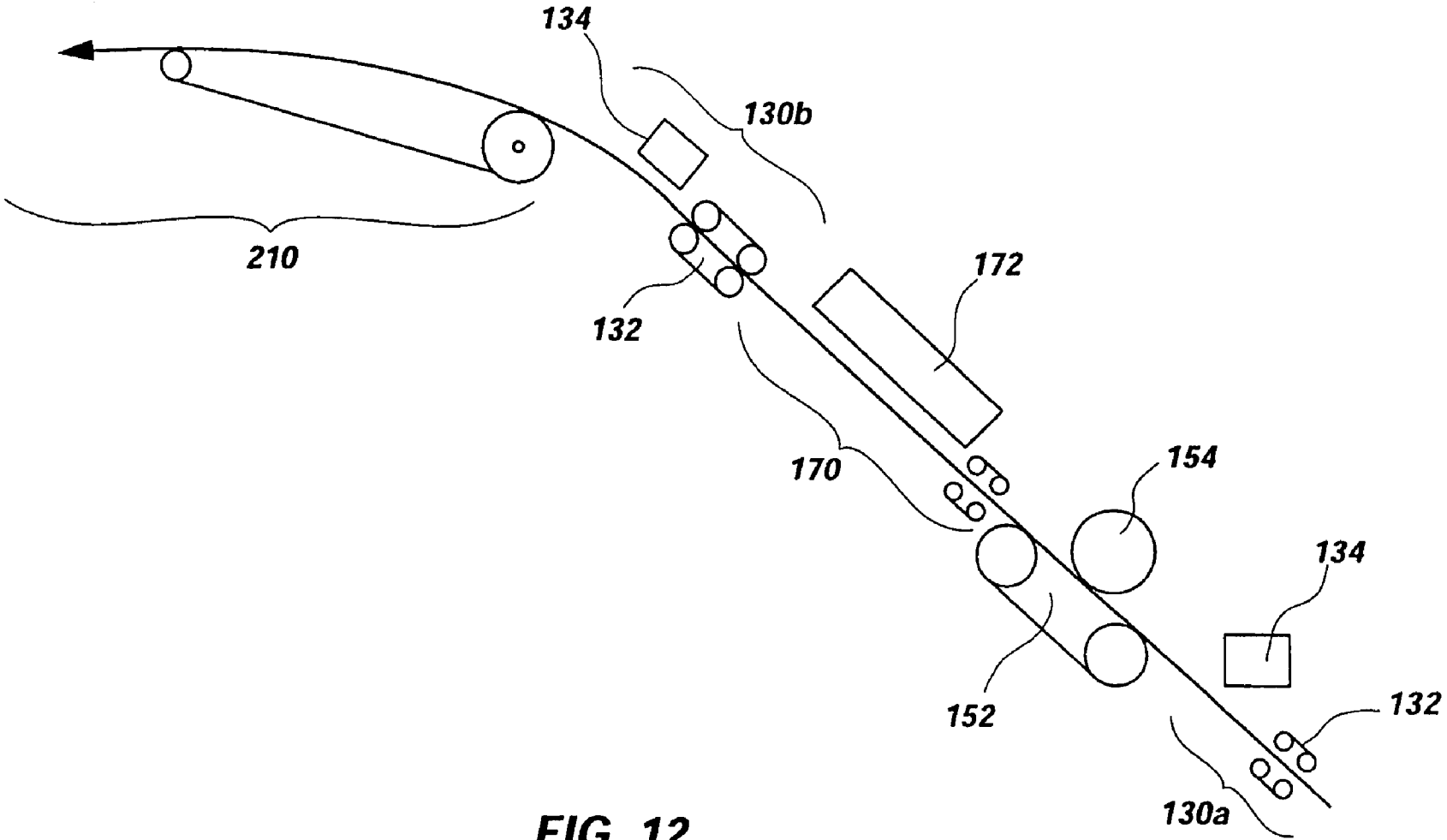
FIG. 12 is schematic representation of one embodiment of a layout of the fabric characterization and tension control subsystem in relation to a fabric pre-conditioning subsystem embodying teachings of the present invention.

Deformations are induced into the fabric 114 in various subsystems of the UFTCS 10 For instance, the deformations are induced by a feed mechanism used to deliver the fabric 114 to the print subsystem 250, the fabric drying and conditioning subsystem 170, the fabric control subsystem 210, and some of the other subsystems. To continually account for the various deformations, the fabric 114 is characterized just before the fabric 114 enters the fabric control subsystem 210. Accordingly, the fabric 114 may be characterized before the fabric drying and conditioning subsystem 170, after the fabric drying and conditioning subsystem 170, or in both locations as illustrated in FIG. 12. FIG. 12 shows the fabric characterization 130*a* and tension control subsystem 130*b* located before and after the fabric drying and conditioning subsystem 170.

To ensure maximum print quality, the pattern should ideally be printed on the fabric 114 in a flat, relaxed, and crease-free state. However, since the fabric 114 is unwound from the fabric roll 112 and subjected to various deformation stresses throughout the machine, presenting the fabric 114 to the print zone in a zero stress condition is not practical. Therefore, a key parameter becomes the minimization of the local distortion and recovery characteristics of the fabrics under the multi-directional strain induced by the various unwinding, de-creasing, ironing, conditioning and feeding stresses. Other stresses induced into the fabric 114 stem from conditioning of the fabric 114 which may include treating the fabric 114 in such a way that various coloring agents adhere more efficiently to the fabric 114. Accordingly, the fabric characterization and tension control subsystems 130*a* and 130*b* are utilized to solve the problems of variable fabric distortions resulting from the various tension forces introduced in the fabric 114. These fabric characterization and tension control subsystems 130 result in decreased variable directional scaling distortions introduced into the fabric 114 throughout the print job.

As further known in the art, stress induced displacements in a fabric 114 greatly affect image distortion, banding, and variations in color plain from color plain alignment in digital and conventional fabric printing systems. Therefore, it is useful to control post-printing distortion of the fabric 114, in addition to the deformations induced from pre-printing load characteristics in the fabric 114. In both post-printing and pre-printing conditioning steps performed on the fabric 114, a stress-free state of the fabric 114 before and after a pattern has been printed thereon should be maintained to minimize the objectionable distortions in the fabric 114.

An additional consideration in post processing is maintaining the same pre-printing fabric characteristics after the pattern is printed on the fabric 114. Therefore, running the fabric 114 through the post-printing process and ascertaining the post-printing characteristics before a pattern is printed thereon helps minimize final variations. Accordingly, measuring the X and Y directional distortions in the post-printing processing and adjusting the pre-printing conditions to accommodate for the post-processing variations helps decrease the specific distortion/scaling within the fabric 114.

As previously discussed herein, since fabric behavior is variable throughout the roll of fabric 114, it is desirable to ascertain the stress/strain behavior in the fabric 114 and set the tensions in the fabric 114 to an optimal and uniform state to better control distortions in the fabric before printing begins. Accordingly, the fabric characterization and tension control subsystem 130 described herein is one possible way to achieve close-loop control needed. Once characterization information is obtained by the fabric characterization and tension control subsystem 130, the information is used to control the pre-printing forces in the fabric and stretch the fabric before it is introduced into the fabric control subsystem 210, thus effectively closing the feedback loop in the UFTCS 10.

In an alternative embodiment, the fabric characterization and tension control subsystem 130 is used as a standalone subsystem in conventional large-scale fabric printing systems. However, the fabric characterization and tension control subsystem 130 works effectively when it is operatively linked to a printing system, such that the fabric characterization and tension control subsystem 130 may be used to dynamically monitor the fabric characteristics throughout the entire printing process.

Referring again to FIG. 1, the fabric characterization and tension control subsystem 130*b* located before the fabric control subsystem 210 is substantially similar to the fabric characterization and tension control subsystem 130*a* located before the irregularity detection and removal subsystem 150. However, the function of the fabric characterization and tension control subsystem 130*b* located before the fabric control subsystem 210 is to control the multi-directional web tension of the fabric 114 before the fabric 114 is laid down on a fabric transfer belt 212*a* of the fabric control subsystem 210 by comparing fast fourier transfer algorithm values, as previously described herein with reference to FIG. 10. The first fabric characterization and tension control subsystem 130*a* is operably connected to the second fabric characterization and tension control subsystem 130*b*, such that data gathered by the first fabric characterization and tension control subsystem 130*a* about fabric characteristics may be utilized by the second fabric characterization and tension control subsystem 130*b*.

Figure 13:
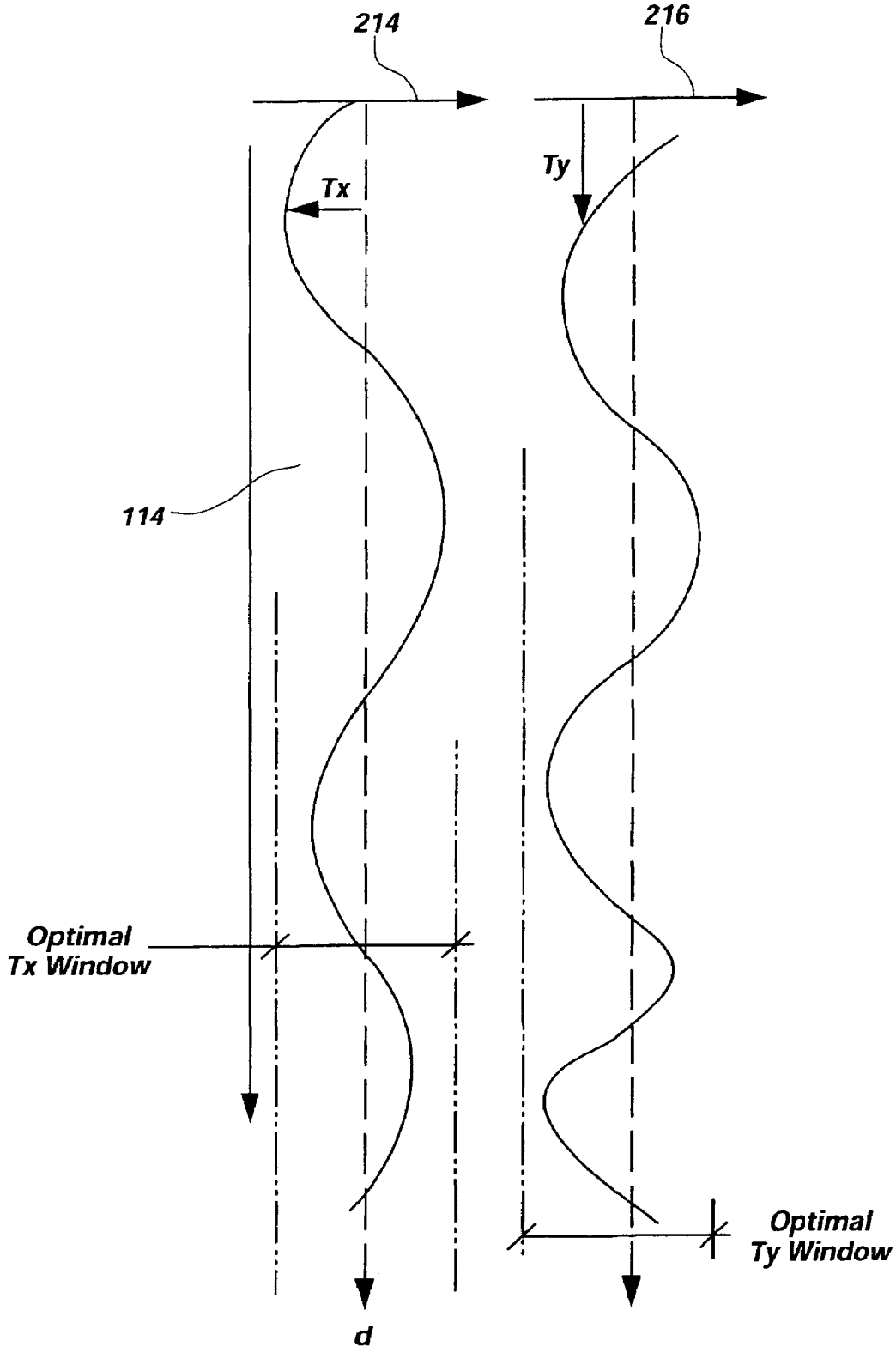
FIG. 13 is schematic representation of a possible orthogonal fabric strain behavior as a function of the induced tension within the fabric. These determinations are made in the fabric characterization and tension control subsystem of on one embodiment of the present invention shown in FIG. 5.
Figure 14:
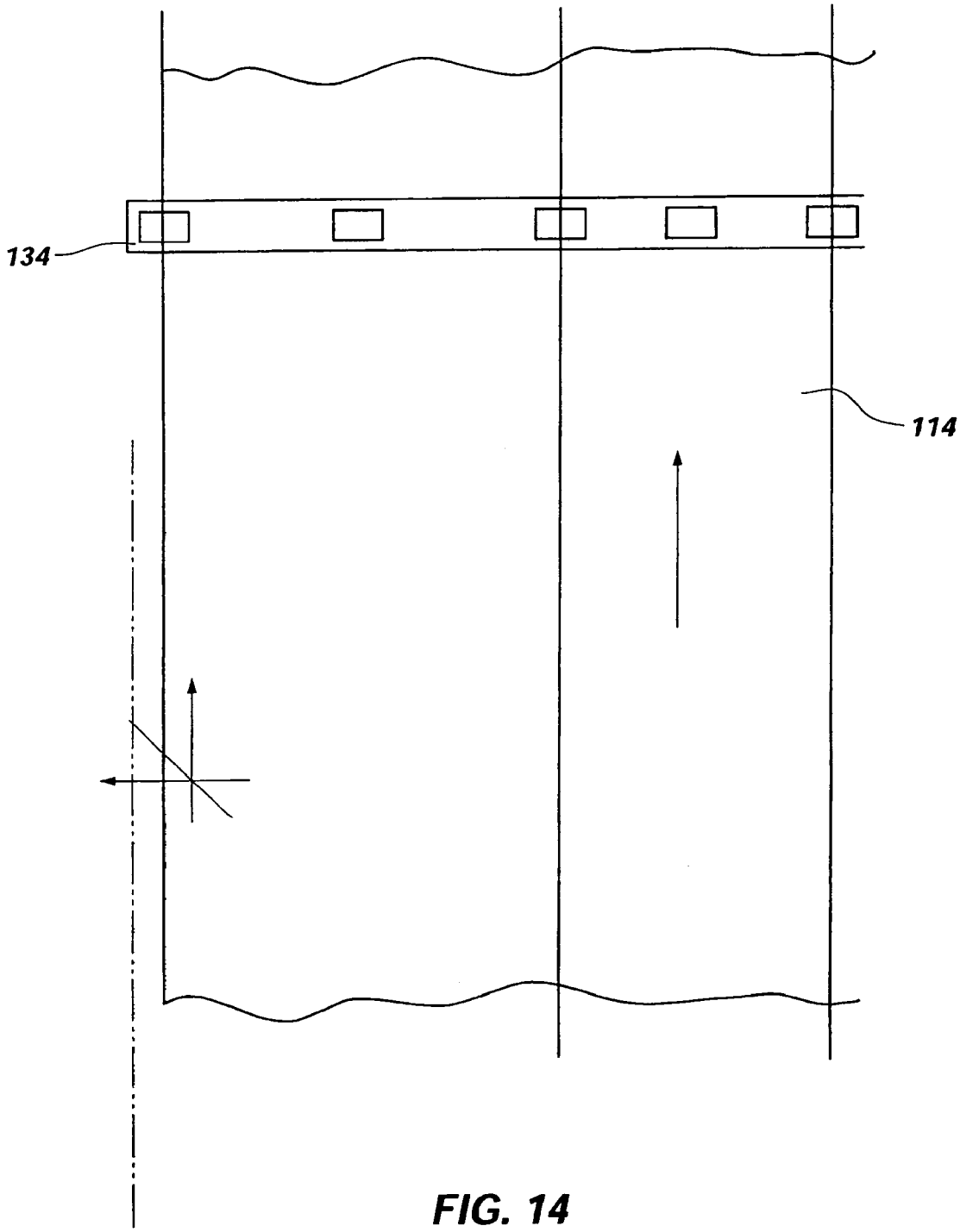
FIG. 14 is a schematic representation of the placement of a CCD array in the fabric characterization and tension control subsystem of FIG. 5.

Referring now to FIG. 13, typical frequency content as a function of displacements is shown in X direction as 214, and in Y direction as 216 in the fabric 114. As shown in FIG. 14, a position of a two dimensional CCD array 134 in relation to the web of the fabric 114 is illustrated. As displayed, the CCD array 134 is across the web of the fabric 114.

Figure 15:
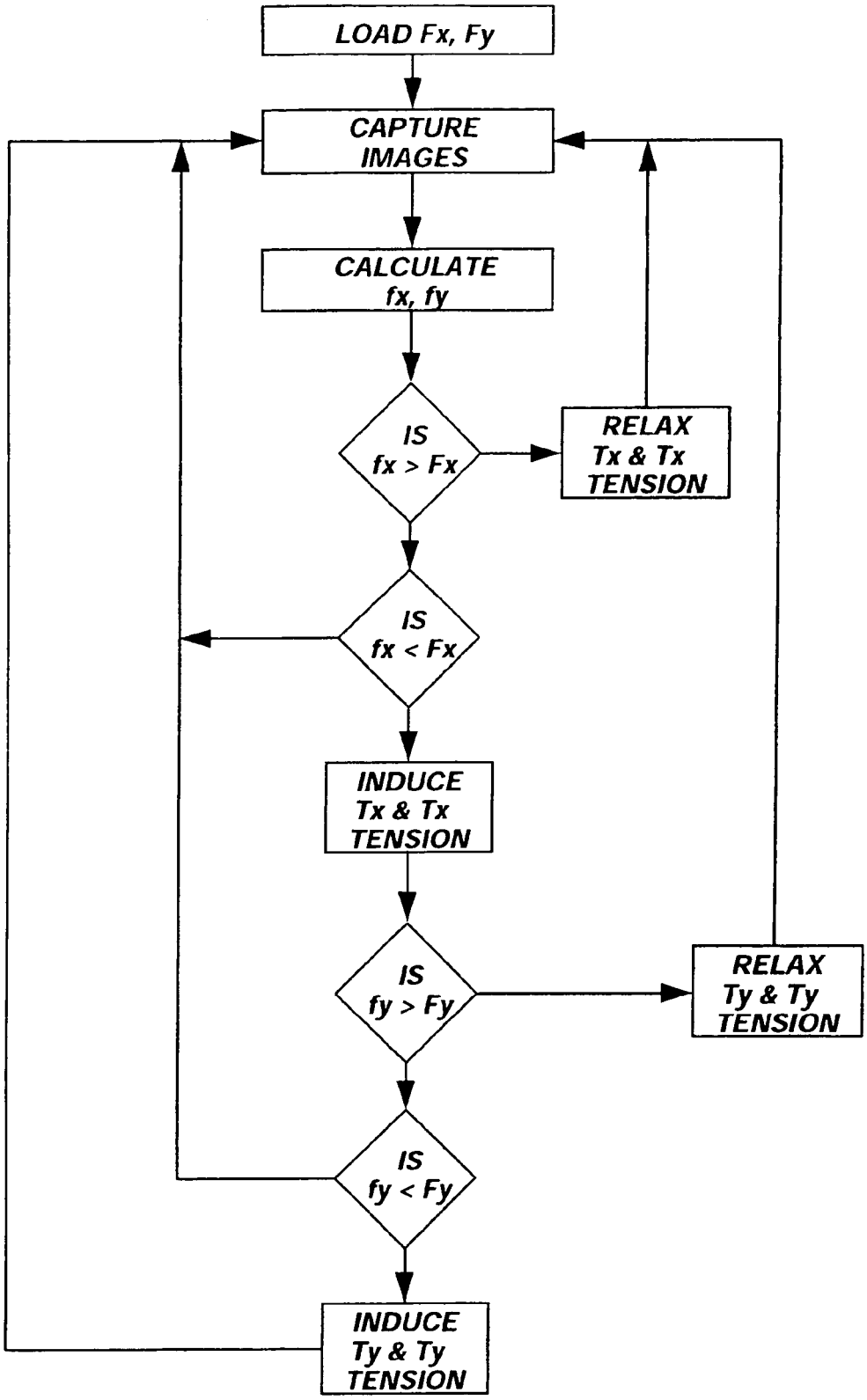
FIG. 15 is a flowchart depicting an algorithm used to maintain web tension in a fabric passing through the fabric characterization and tension control subsystem of one embodiment of the present invention shown in FIG. 5.

The amount of web tension in the fabric 114 could be preset as a constant value that is maintained and controlled by the UFTCS 10 or the web tension may be monitored and controlled in real time. If the web tension is maintained and controlled in real time, a control system of the UFTCS 10 may continually adjust the optimal tension for a given fabric type and variation using a flowchart algorithm illustrated in FIG. 15.

Once the web tension in the fabric 114 is characterized, the fabric 114 enters the fabric control subsystem 210 in as flat and controlled manner as possible. As illustrated in the embodiment of FIG. 1, the fabric control subsystem 210 comprises a pair of substantially identical fabric transfer belts 212*a* and 212*b* supported by two fabric transfer belt idler rollers 219, a fabric advance sensor 220, the print subsystem 250, and a dryer 222. The fabric control subsystem 210 functions to hold and advance the fabric 114 received from the tension control subsystem 130*b* and present the fabric 114 to the print subsystem 250 in a flat and controlled manner. After a pattern is printed on the fabric 114, the fabric control subsystem 210 transports the fabric 114 to the drying and post processing subsystem 310.

Figure 16:
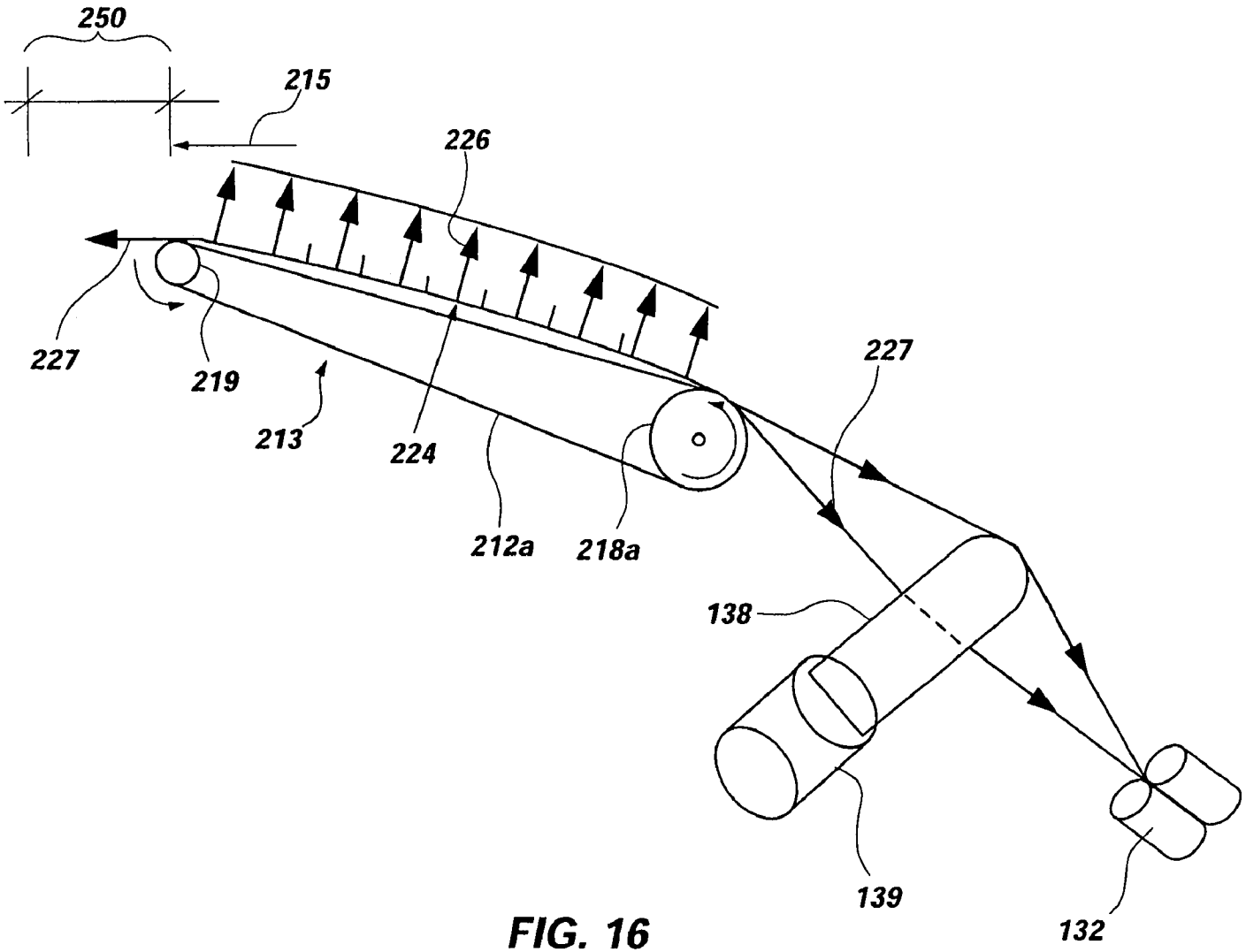
FIG. 16 is an expanded view of one embodiment of a fabric tension control subsystem used in the unbacked fabric transport and conditioning system of FIG. 1.

The fabric transfer belts 212*a* and 212*b* are individually driven by fabric transfer belt rollers 218*a* and 218*b* and are configured to move synchronously with respect to each other. Referring to FIG. 16, there is shown an expanded view of one of the fabric transfer belts 212*a* located between the print subsystem 250 and the bowed roller 138 driven by the bowed roller drive motor 139, and the skewed roller 132. The fabric transfer belts 212 are metallic or fiber reinforced polymer belts that span the driven roller 218 and an idler roller 219. A curved plate 224 is placed under each fabric transfer belt 212, wherein the curved plate 224 is configured to induce a large radius in the surface of the fabric transfer belt 212, which helps to hold the fabric down on the belt. The radius of the curved plate 224 provides a perpendicular component from the tension force, as illustrated by arrows 226 to the fabric 114, wherein the tension force 226 induces a normal force due to the curved plate 224 onto the fabric 114 on the fabric transfer belt 212 and prohibits the fabric 114 from moving in relation to the fabric transfer belt 212.

A surface 213 of the fabric transfer belts 212 may be roughened by plasma treatment of the surface of the fabric transfer belts 212, if the belts are metallic, or by gluing a layer of abrasive particles to a surface of the fabric transfer belts 212, if the belts are polymeric. The roughened surface 213 provides randomly positioned high points that dig into the weave of the fabric 114, and functions in concert with the normal force 226 to prevent the fabric 114 from moving with respect to the fabric transfer belt 212, thus negating the need for adhesives. Various types, grades and levels of roughness on the surface of the fabric transfer belts 212 may be provided to accommodate the different weaves or types of fabric 114 of the UFTCS 10. Accordingly, the fabric control subsystem 210 is configured to allow for easy removal and replacement of the fabric transfer belts 212.

The fabric transfer belts 212 also have encoders (not illustrated) on an underside or edge thereof that allow control feedback signals to be accurately monitored by a fabric advance subsystem of the UFTCS 10. The encoders may comprise carriage axis encoder strips known to those of ordinary skill in the art and conform to the actual shape of the fabric transfer belts 212. The driven rollers 218 are powered with matched encoded servo drives such that each driven roller 218*a* and 218*b* moves synchronously in relation to each other. The separate drive systems that power the fabric transfer belts 212 may be controlled and synchronized using a closed-loop control scheme. The closed-loop control scheme may include high precision encoders on the matched servo drives powering each driven roller 218 that function in concert with the encoders of the fabric transfer belts 212, thus functioning to control the displacement of the fabric transfer belts 212*a* and 212*b* and minimizing changes in characteristics in the fabric 114 during printing. Further, it will be apparent that a width of the fabric transfer belts 212 is wider than the widest width of the fabric 114 that will be used in the UFTCS 10, such that the entire width of the fabric 114 is supported by the fabric transfer belts 212. To provide for better accommodation and tension control of various fabrics, the fabric control subsystem 210 is configured such that the fabric transfer belts 212 may travel in a direction indicated by arrow 215.

As further illustrated in FIG. 1, the fabric advance sensor 220 includes a navigation sensor system (such as that described in U.S. Pat. No. 6,195,475, "Navigation System for Handheld Scanner," Beausoleil and Allen, assigned to Hewlett-Packard Company). The fabric advance sensor 220 uses low angle lighting to create high contrast shadow patterns on a surface of the fabric 114, such that a CCD array of the fabric advance sensor 220 captures images of the surface of the fabric 114. Using electronics and software of the navigation sensor system, the axis motion of the fabric 114 may be controlled in order to minimize banding and other motion variables of the fabric 114 in order to minimize distortion and irregular printing patterns of the fabric 114 during the printing process. The fabric advance sensor 220 is operably connected to both fabric characterization and tension control subsystems 130*a* and 130*b*, such that the fabric characteristics may be accounted for in the printing process.

Figure 17:
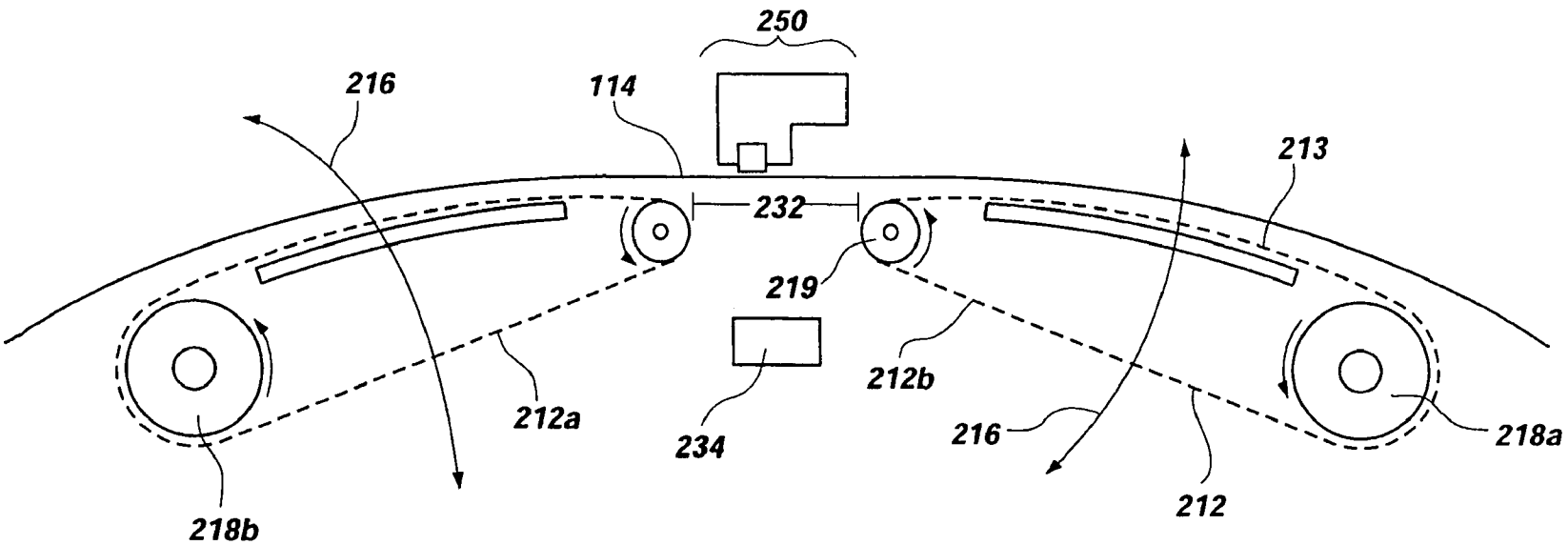
FIG. 17 is a schematic representation of the fabric motion control subsystem of FIG. 16 in relation to a print subsystem of one embodiment of the present invention.

Referring to FIG. 17, the print subsystem 250 is located between fabric control belt 212*a* and fabric control belt 212*b*. As illustrated, as the fabric 114 passes from fabric control belt 212*a* to fabric control belt 212*b* under the print subsystem 250, the fabric 114 is unsupported for a distance 232. As known in the art, ink-jet droplets may pass through, or blow through, the fabric 114 as the ink droplets are transferred through the air during the printing process and would contaminate a continuous belt supporting the fabric 114. Contamination of the belt requires use of a solvent or water to clean the belt. By designing the system to print on the unsupported fabric 114 in the illustrated print subsystem 250, the ink may blow through the unsupported distance 232 and will not contaminate the fabric control belts 212*a* and 212*b*. In this manner, the UFTCS 10 does not require water hook ups or other solvent cleaning systems, which are dirty and environmentally unfriendly. As illustrated, the ink that inevitably blows through the fabric 114, may then be collected by a collection device 234. Such as a trough, pad, or a vacuum system located under the printing subsystem 250.

In addition to preventing ink contamination on the fabric control belts 212, the two fabric control belts 212*a* and 212*b* are configured to provide back resistance to tensioning rollers of the UFTCS 10. The fabric control belts 212 are configured to move in a direction indicated by arrow 215 such that tension applied to the fabric by the UFTCS 10 may be accurately controlled. The design of the illustrated fabric control subsystem 210 also dictates that the unsupported distance 232 between fabric control belts 212*a* and 212*b* is minimized, such that the distance 232 of the unsupported fabric 114 floating freely is minimized. Accordingly, the distance 232 between fabric control belts 212 should be slightly larger than a swath height of an ink jet head used in order to avoid ink droplets contaminating the same.

Figure 18:
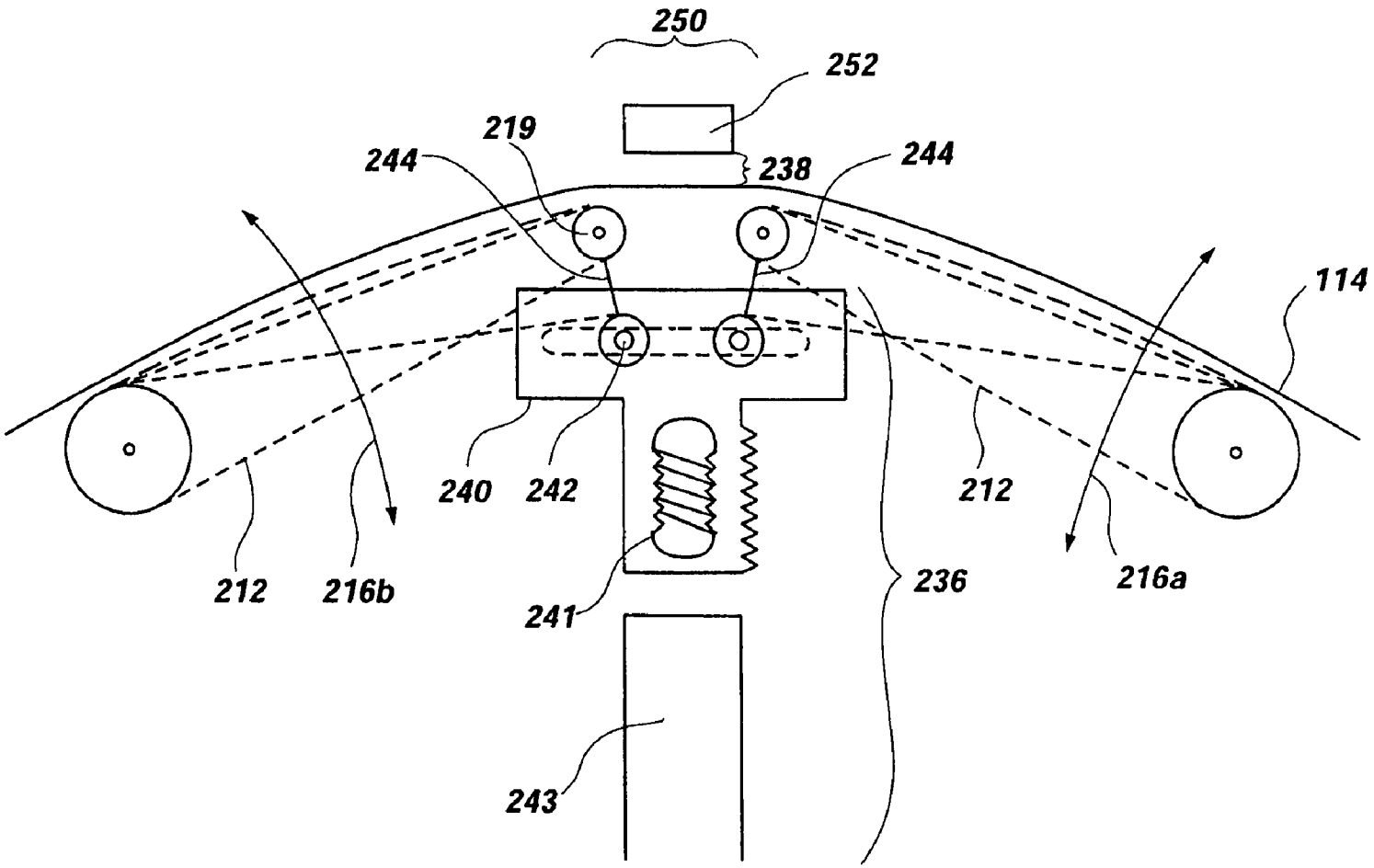
FIG. 18 is a schematic representation of a second embodiment of a fabric motion control subsystem in relation to an adjustable print head to fabric distance-control system in a print subsystem embodying teachings of one embodiment of the present invention.

Referring now to FIG. 18, there is shown a cross sectional view of a mechanism generally at 236 designed to allow the fabric transfer belts 212 travel in the direction indicated by arrows 216*a* and 216*b*. An adjustable print head 252 to fabric 114 gap 238, thus allowing for an optimal print quality of patterns to be printed on a wide variety of fabric weights and thicknesses. The mechanism 236 communicates with the irregularity detection and removal subsystem 150 such that the fabric 114 may be lowered away from the print subsystem 150 to prevent a knot from contacting and potentially damaging the print heads 252. A T-bracket 240 on each end of idler shafts 242, which support the idler rollers 219, include slide guides by which the idler rollers 219 may be raised and lowered to control the distance between the fabric 114 and the print heads 252 of the print subsystem 250. The T-brackets 240 may be moved up and down, thereby moving the fabric surface up and down. The T-brackets 240 may be moved with a screw drive 241 that is powered by a servo drive 243. The pivot points of the idler rollers 219 will be upwardly spring loaded onto the guide grooves of the T-brackets 240 in order to provide controlled vertical movement of the idler rollers 219 and the spring-loaded tension will force the idler shaft 242 to pivot, such that the surface of the fabric 114 runs in a controlled manner. The above spring force also provides a backlash control force to the rack and pinion arrangement on the bracket.

Since the actual printed colors on the fabric 114 do not develop their final color appearance until the fabric 114 is post-processed, the real color value of the printed fabric 114 cannot be ascertained until the post-processing of the fabric 114 is complete. An actual ink flux and lay down pattern of the ink printed on the fabric 114 varies throughout the print job due to thermal head assembly (THA) variations, thermal drift, the varying fabric white point and the lack of weave uniformity in the fabric 114. Accordingly, these variations affect the final color of the fabric, and hence the outcome of the print job after post-processing. These variations may be sensed and adjusted in real time throughout the print job to accommodate these dynamic variations and minimize varying color appearances on the printed fabric.

In the illustrated embodiment, these variations are sensed in the color consistency densitometry subsystem 330 of FIG. 1. As known in the art, these variations are amplified in digital printing processes by a natural color of the fabric, because unlike traditional printing systems, the fabric 114 printing process using ink jet printers do not saturate the fabric with the coloring agents. Rather, a minimal amount of ink is placed upon the fabric in digital printing systems that are only 10 to 20 percent of the amount of coloring agents applied to the fabric in conventional printing systems. Since a white point of the fabric 114 varies throughout the fabric roll 112, a carriage sensor 270 may be used as a white point calibration system for the color consistency densitometry subsystem 330. The carriage sensor is used to sense the white point of the fabric and may be operatively configured to direct the components of the print subsystem 250 to adjust the amount of ink laid down on the fabric 114 and ensure color consistency.

Color consistency needs are further ensured in real time by printing specific fill patterns on a fabric salvage area and scanning an optical densitometer over these fill patterns in real time. As known in the art, the fabric salvage area is usually a ¼- to ½-inch strip along both edges of the fabric 114. A choice of fill patterns may be made automatically and dynamically, or manually, for each individual print job in accordance with the print patterns and respective patterns printed on the fabric 114. By observing a drift of the reflectance values of the fill patterns, the thermal ink jet drive data may be corrected for some of the thermal head drift effects.

It will be apparent to those of ordinary skill that actual image coverage patterns are printed on the fabric 114 and, when combined, form the desired colors in any given print job. The actual image coverage patterns are loaded into their respective registers at the appropriate time, i.e., after tension and color calibrations are determined when fabric dependent calibrations are initially performed, before printing. Signals required to produce the actual image coverage patterns are sent to a carriage board, and printed on the salvage area of the fabric for monitoring. The carriage sensor 270 of the color consistency densitometry subsystem 330 is used to read an average value of the optical density of the printed patterns on the fabric salvage area during the print job. The average values are compared to pre-print job calibration values and the timing and operating parameters of the thermal head assembly may be varied to compensate for the variations. To enhance the ability of the carriage sensor to sense the color variations, several additional multicolor LED light sources may be added such that the carriage sensor is able to recognize additional wavelengths of the textile inks.

Figure 19:
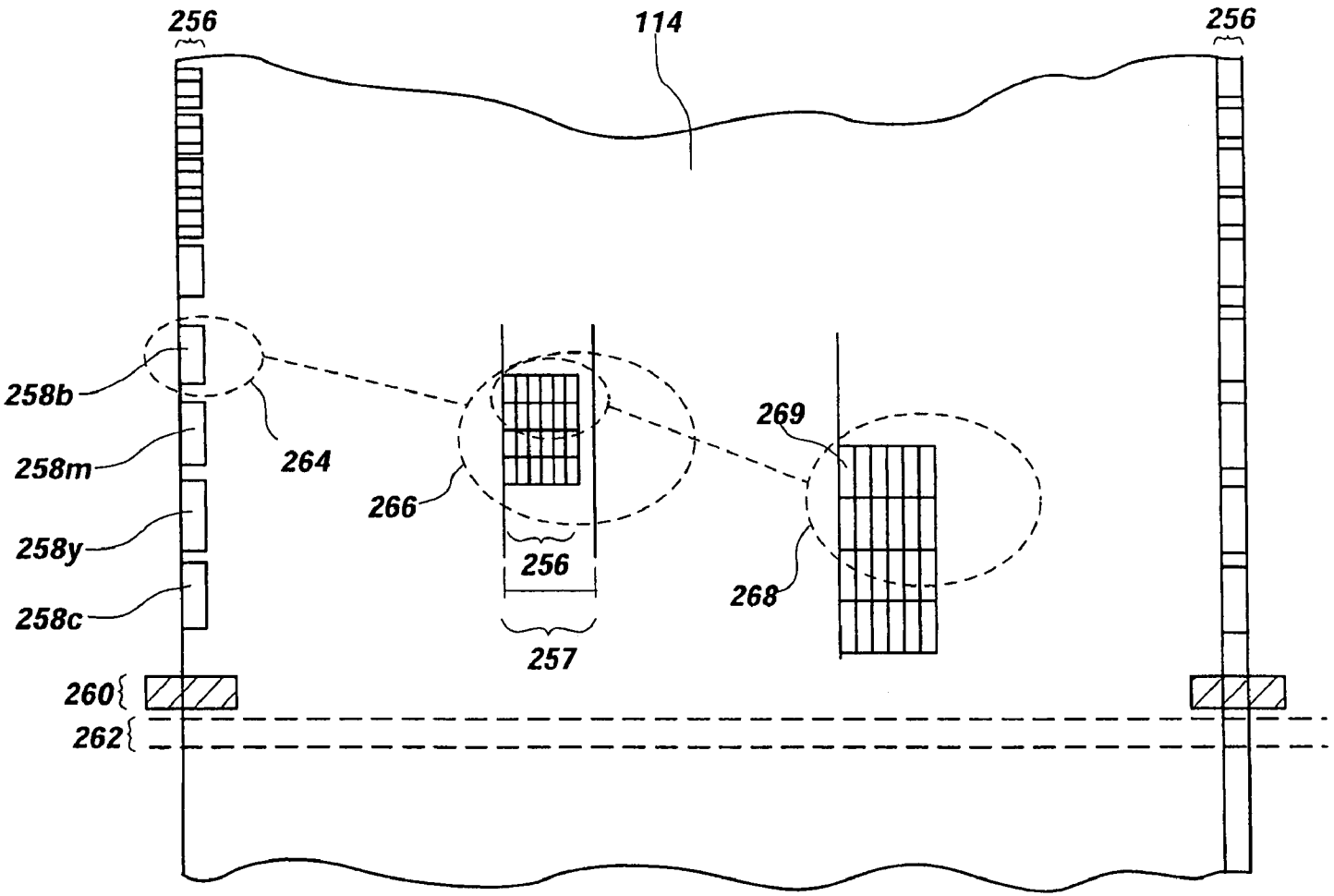
FIG. 19 is a diagram of one embodiment of a print pattern that could be used to monitor the color and the actual density of an ink that is being deposited, using a color consistency densitometry subsystem of FIG. 1 embodying teachings of one embodiment of the present invention.

Referring now to FIG. 19, there is illustrated one possible embodiment of an edge print pattern that may be printed in the fabric salvage area 256 of the fabric 114. The edge print pattern may be printed at all times throughout the print job or performed as needed by the UFTCS 10. As illustrated, each edge of the fabric 114 includes the fabric salvage area 256. Boxes 258 are test areas printed in the fabric salvage area 256 for each printed color. For instance, box 258*b* can be printed with black ink, box 258*m* can be printed with magenta ink, box 258*y* can be printed with yellow ink, and box 258*c* can be printed with cyan ink. After the pattern is printed on the fabric 114 in the print zone 262, the boxes 258 are scanned by the carriage sensor, or densitometer, in a scan zone 260. Circular area 264 is expanded in area 266 which includes a plurality of boxes, wherein each box 269 represents a swath of ink printed by each print head 252. Circular area 266 is further expanded in area 268 and includes each box 269, or swath of printed ink.

The edge print pattern, illustrated in FIG. 19, is performed substantially continuously throughout a printing process, such that densitometry of the predetermined ink lay-down patterns represented by boxes 269 is determined. As known in the art, the drop volume, directionality, and velocities of the ink released from each print head 252, as well as the average and local adsorption of the test swaths of ink, will drift and vary. Therefore, continuous monitoring of the test swaths serves as a control parameter that may be fed into the energy management and the drop generation systems of the UFTCS 10. Proper adjustment of the energy, timing and the ink lay-down patterns of the print heads 252 minimize the drop volume and directionality drifts of the ink released from the print heads 252, and therefore minimize variation of a final color outcome printed on the fabric 114 in the print job.

After a pattern is printed on the fabric 114, post-processing of the fabric 114 is required. Since fabrics do not dry as rapidly as paper after printing, drying equipment is often a standard feature of fabric ink-jet printing systems. Also, since ink-jet printing on fabric requires two to six times the amount of ink that is traditionally printed on paper, drying of the printed fabric is important. To aid the drying process, a dryer 222, such as a heater blower, is a rapid drying device that can be incorporated in the drying and post processing subsystem 310 of FIG. 1. As illustrated, the dryer 222 is located directly after the print subsystem 250 and produces enough heat energy output capacity to also cure two-part pigmented ink systems.

After drying, the fabric 114 is subjected to further post-processing steps in order to fix and develop a final color of the dye or pigment on the fabric 114. As known in the art, post-processing may be accomplished either mechanically or chemically. Depending on the type of ink printed on the fabric, various fixing, or post-processing, steps used on the fabric 114 may include the following: dry heat for use with pigment/binder inks and dispersed dyes; saturated steam for use with acid dyes, dispersed dyes, and reactive dyes; or saturated steam combined with a chemical for use with some reactive dyes. In the illustrated UFTCS 10 of FIG. 1, there is shown a dry heat device 312 and a steamer 314 within the drying and post processing subsystem 310. It will be apparent that the illustrated UFTCS 10 may include a different type of post-processing device, or no post-processing device, depending on the type of ink used. For instance, if the fabric 114 is stored and post-processed off-line with another piece of equipment, a post-processing device may not be part of the UFTCS system 10. Of course, since inks may not be in a stable state, the rolls of printed fabric may need to be dried and carefully handled in order to ensure that the printed patterns are not degraded or distorted by factors such as touch, pressure, tension, etc.

Incorporation of the post-processing subsystem 310 within the print system allows a color fidelity check to be performed on-line with the printing process. Thus, it is efficient to incorporate the post-processing subsystem 310 within the print system as illustrated in FIG. 1. For instance, since certain color chemistries dramatically shift after post processing, i.e. blue to brown in a reactive system, incorporation of the drying and post-processing subsystem 310 into the print system allows a closed-loop color control subsystem to be incorporated within the printing system. Without post-processing, initial calibration and instrument readings of a pseudo closed-loop system would need to be the indicator of the true color, and any color variation or shift could not be corrected in the same roll of fabric that is being printed.

In implementing the drying and post-processing subsystem 310, factors to be considered in the design of the dry heat device 312 and steamer 314 include: time required for the post-processing stage of the type of ink chemistry employed, control of steam temperature, amount of steam required, consistency of steam flux, need for a hard water line, and segregation of the unfixed printed fabric face from the steam before the unfixed printed fabric is post-processed. These factors affect the quality, durability and the handling characteristics of the finished printed fabrics. The construction and configuration of the drying and post-processing subsystem 310 is similar to the configuration of the fabric drying and conditioning subsystem 170, 150 (illustrated in FIG. 1) and the components thereof, as described with reference to FIG. 8 and FIG. 9.

Once the fabric 114 is post-processed, the fabric 114 passes through the closed-loop color control subsystem 330, as illustrated in FIG. 1. It will be apparent to those of ordinary skill in the art that if the closed-loop color control subsystem 330 is part of the UFTCS 10, that the UFTCS 10 will also include the drying and post-processing subsystem 310 because the quality of the color printed on the fabric 114 cannot be ascertained unless the ink is post-processed. As known in the art, fabrics have a larger variation with printed colors than paper because variations in fabric weaves and interactions between the ink and the fabric. Accordingly, values of actual achieved colors are loaded into the UFTCS 10 on a job-to-job basis depending on the type of fabrics and inks used. These values may be loaded once the color map of the final proof is calibrated and linearization is performed, such that the desired adjustments are included. Also, since there is a time delay between the moment the ink is laid down and the time that the final colors are measured, adjustments made to the UFTCS 10 to accommodate for color variation is limited by the time delay.

Figure 20A:
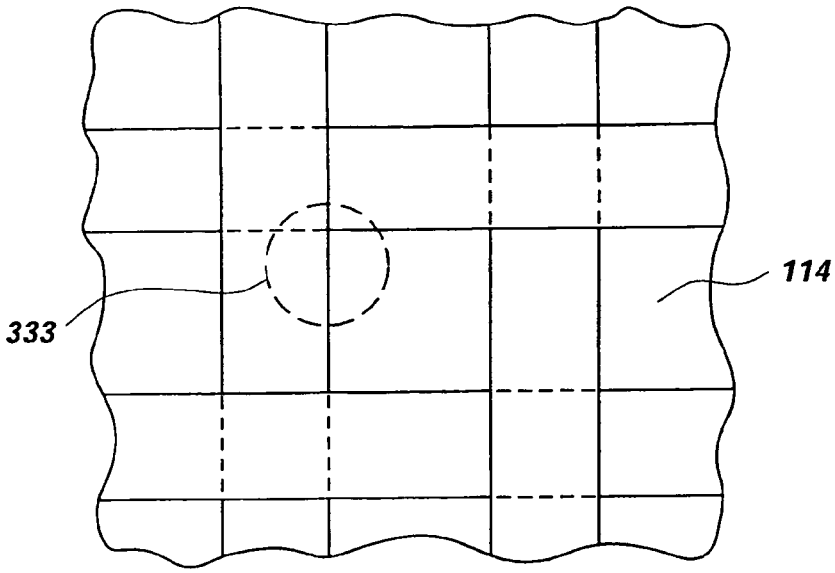
FIG. 20A is a diagram of a field of view of a current carriage sensor in one embodiment of the present invention used to measure color in a closed-loop color control subsystem of FIG. 1.
Figure 20B:
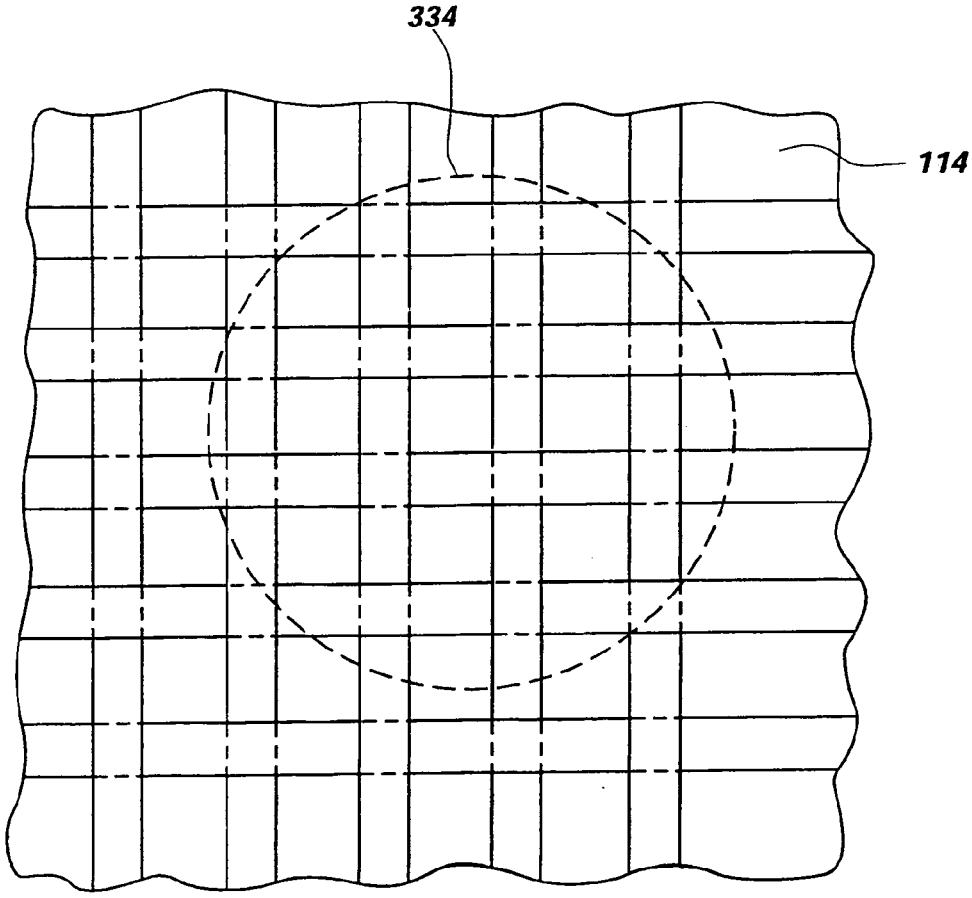
FIG. 20B is a diagram of an embodiment of a widened field of view of a carriage sensor used in the closed-loop color control subsystem of FIG. 1.

The closed-loop color control subsystem 330 may use a variety of different sensors to measure the color variation of the printed fabric. For instance, a sensor 332 of the closed-loop color control subsystem 330 may be similar to the carriage sensor of the color-consistency densitometry subsystem 270. However, to achieve a higher resolution due to a small field of view of the carriage sensors, the carriage sensors can be widened. For instance, as illustrated in FIG. 20A, there is shown a field of view 333 within a weave of a fabric 114, while a wider field of view 334 that may be achieved by widening the field of view of the carriage sensor, which is illustrated in FIG. 20B, as encompassing a larger weave area in the fabric 114. Furthermore, various light sources of differing color wavelengths can be used to further enhance the color information being gathered. Widening the carriage sensors provides a more integrated average signal and avoids localized ink-to-fabric interactions that may produce an abnormal color measurement. For ease of color measurement, the colors printed on the fabric salvage area in the color consistency densitometry subsystem 270 may be used for color measurement in the closed-loop color control subsystem 330. If the colors of the fabric salvage area are measured, a well balanced and natural light source should be used for color measurement in both the color consistency densitometry subsystem 270 and the closed-loop color control subsystem 330. It will be appreciated that an algorithm may be used to process the measured color of the fabric 114.

Once the fabric 114 has been post-processed, the fabric 114 passes through a relaxation subsystem 350, as illustrated in FIG. 1. The relaxation subsystem 350 includes an optical dancer bar 116, similar to the optical dancer bar 116 of the unwind subsystem 110, and a relaxation subsystem 350, which performs functions essentially the same as those described herein with reference to the relaxation zone 113 related to the unwind subsystem 110.

As further illustrated in FIG. 1, the UFTCS 10 also includes the rewind zone 370. It will be apparent to those of ordinary skill in the art that the rewind zone 370 is substantially identical to the unwind subsystem 110 of FIG. 1, except that the rewind zone 370 winds the fabric 114 onto a finished printer roll 372 instead of unwinding the fabric from the roll 112 of unprinted fabric.

Although various components of the subsystems have been described herein as being in-line with the UFTCS 10, it will be apparent that various components, subsystems, and zones of the UFTCS 10 may be implemented off-line or separate from the UFTCS 10 and still be encompassed by the present invention. Thus, the various components, subsystems, and zones of the described UFTSC 10 may be used with other digital printing systems or utilized in conjunction with other conventional printing systems.

Although the present invention has been shown and described with respect to various illustrated embodiments, various additions, deletions and modifications that are obvious to a person of ordinary skill in the art to which the invention pertains, even if not shown or specifically described herein, they are deemed to lie within the scope of the invention as encompassed by the following claims.

What is claimed is:

1. A method for printing a pattern on a fabric, comprising:

unwinding a fabric from a fabric roll;

draping said fabric between said fabric roll and at least one roller, wherein an apex of the draped fabric is sensed by at least one fabric-level sensor;

controlling a speed of said unwinding of said fabric by sensing said apex of said draped fabric;

ascertaining characteristics of said fabric by stretching said fabric with a skewed roller, capturing images of said stretched fabric, and evaluating said captured images;

depositing ink on said fabric; and rewinding said fabric on a roll.

2. The method according to claim 1, further comprising discovering irregularities in said fabric.

3. The method according to claim 2, wherein said discovering step comprises:

illuminating a surface of said fabric;

capturing images of said illuminated fabric surface; and determining a presence of said irregularities with an algorithm.

4. The method according to claim 3, further comprising lowering said fabric when said irregularity is in a print zone.

5. The method according to claim 1, further comprising removing creases from said fabric.

6. The method according to claim 5, further comprising:
wherein removing creases from said fabric comprises passing said fabric over a steam table and ironing said fabric with an ironing apparatus; and
drying said ironed fabric with a fabric-drying and conditioning subsystem.

7. The method according to claim 1, further comprising controlling a web tension of said fabric.

8. The method according to claim 1, further comprising advancing said fabric through a print zone with at least two fabric transfer belts, wherein said ink is deposited on said fabric between said at least two fabric transfer belts, such that said fabric is unsupported at the location at which said ink is deposited.

9. The method according to claim 1, further comprising monitoring an ink flux and a lay down pattern of said ink deposited on said fabric.

10. The method according to claim 9, wherein said monitoring of said ink flux and said lay down pattern comprises:
depositing swaths of ink in a fabric salvage area of said fabric;
capturing images of said swaths; and
calculating a coverage of said ink of said swath with an algorithm.

11. The method according to claim 1, further comprising drying and fixing said ink deposited on said fabric.

12. The method according to claim 1, further comprising measuring a color of said ink deposited on said fabric.

13. The method according to claim 1, further comprising relaxing said fabric after said ink has been deposited thereon.

14. The method according to claim 1, further comprising collecting ink that blows through said fabric.

15. The method according to claim 1, wherein capturing images of said stretched fabric comprises capturing images of said stretched fabric with a charge-coupled device (CCD) array.

16. The method according to claim 1, wherein capturing images of said stretched fabric comprises capturing images of said stretched fabric with a charge-coupled device (CCD) camera.

17. The method according to claim 1, wherein evaluating said captured images comprises observing a weave pattern frequency of a weave of said fabric.

18. The method according to claim 17, wherein evaluating said captured images further comprises determining a fundamental frequency content of said weave.

19. The method according to claim 18, wherein determining a fundamental frequency content of said weave comprises determining said fundamental frequency content using a Fourier transform algorithm.

20. The method according to claim 1, wherein evaluating said captured images comprises identifying shadows cast by creases or surface irregularities of said fabric.

21. The method according to claim 1, further comprising illuminating said fabric when said images are captured.

22. The method according to claim 21, wherein illuminating said fabric comprises illuminating said fabric using low-angle light sources.

23. A method for printing a pattern on a fabric, comprising:
unwinding a fabric from a fabric roll;
draping said fabric between said fabric roll and at least one roller, wherein an apex of the draped fabric is sensed by at least one fabric-level sensor;
controlling a speed of said unwinding of said fabric by sensing said apex of said draped fabric;
ascertaining characteristics of said fabric by stretching said fabric with a skewed roller, capturing images of said stretched fabric, and evaluating said captured images;
depositing ink on said fabric;
rewinding said fabric on a roll;
illuminating said fabric using low-angle light sources; and
sequentially strobing said light sources.

24. A method for printing a pattern on a fabric, comprising:
unwinding a fabric from a fabric roll;
draping said fabric between said fabric roll and at least one roller, wherein an apex of the draped fabric is sensed by at least one fabric-level sensor;
controlling a speed of said unwinding of said fabric by sensing said apex of said draped fabric;
ascertaining characteristics of said fabric by observing a weave pattern in said fabric, wherein ascertaining said characteristics of said fabric comprises:
stretching said fabric with a skewed roller,
capturing images of said stretched fabric, and
ascertaining tension forces of said weave pattern with an algorithm;
depositing ink on said fabric; and
rewinding said fabric on a roll.

* * * * *